United States Patent [19]

Lambert et al.

[11] 4,421,639

[45] Dec. 20, 1983

[54] RECOVERY OF DEASPHALTING SOLVENT

[75] Inventors: John S. Lambert, New Providence, N.J.; Joseph W. Gleitsmann, deceased, late of Springfield, N.J., by Virginia E. Gleitsmann, executrix

[73] Assignee: Foster Wheeler Energy Corporation, Livingston, N.J.

[21] Appl. No.: 402,447

[22] Filed: Jul. 27, 1982

[51] Int. Cl.[3] ..... C10G 21/00; C10G 21/28

[52] U.S. Cl. ..... 208/309; 208/86; 208/321

[58] Field of Search ..... 208/309, 321, 86

[56] References Cited

U.S. PATENT DOCUMENTS

| | | | |
|---|---|---|---|
| 2,616,912 | 11/1952 | Dickinson | 208/309 |
| 2,727,847 | 12/1955 | Hunn | 208/321 |
| 2,850,431 | 9/1958 | Smith | 208/321 |
| 2,943,050 | 6/1960 | Beavon | 208/309 |
| 3,830,732 | 8/1974 | Gatsis | 208/309 |
| 3,975,396 | 8/1976 | Bushnell et al. | 208/309 |
| 4,017,383 | 4/1977 | Beavon | 208/309 |

*Primary Examiner*—Delbert E. Gantz
*Assistant Examiner*—Glenn A. Caldarola
*Attorney, Agent, or Firm*—Marvin A. Naigur; John E. Wilson; Warren B. Kice

[57] ABSTRACT

The invention is an energy-efficient improvement in a continuous deasphalting process in which a mixture of viscous hydrocarbon oils with resins and/or asphaltenes is contacted with a quantity of pure or mixed hydrocarbon solvents including, but not limited to, propane, butane, pentane, hexane, heptane, isomers thereof, and unsaturated hydrocarbons of similar molecular weights, in order to separate a primary extract phase comprising high viscosity oil, resins and/or asphaltenes, and solvent. The primary raffinate phase is further contacted with an additional quantity of solvent comprising similar components to those in the primary solvent (but not necessarily identical thereto) to separate a secondary extract phase comprising high viscosity oil and solvent, and a secondary raffinate phase comprising resins and/or asphaltenes and solvent. The contacting step may be repeated as often as desired to make additional extract phases which are recovered separately. The solvents from the extract and raffinate phases are separated from the associated viscous oils, resins and/or asphaltenes, and reused in the contacting process. Several embodiments of the invention are disclosed. In each embodiment, the primary and secondary recovery systems are integrated so that heat recovered from the primary solvent is used to operate the secondary recovery system.

21 Claims, 3 Drawing Figures

RECOVERY OF DEASPHALTING SOLVENTBACKGROUND OF THE INVENTION (1) Field of the Invention The invention is in the field of treating asphaltic and/or resinous oils with a deasphalting solvent for the separation of asphaltic and/or resinous constituents therefrom. More particularly, the invention is concerned with solvent deasphalting processes in which the solvent is recovered and recycled.

(2) Description of the Prior Art

U.S. Pat. No. 2,850,431 to Smith deasphalts a heavy hydrocarbon oil with a light alkane solvent (col. 1, lines 30–40). The solvent is evaporated from the primary extract phase in expansion valve 34 and the vapors are heat exchanged with the remaining extract phase in heat exchangers 42*a*, 42*b* and 42*c* to heat the extract phase for more solvent evaporation in drum 46. Cooled solvent is returned to the extractor 26 through line 29.

U.S. Pat. No. 3,318,804 to Van Pool et al relates to solvent deasphalting a heavy hydrocarbon oil with a propane solvent. In FIG. 1, the extract phase is subjected to high pressure evaporation in vessel 1 and the latent heat of the propane vapor is transferred to the kettle product in heat exchanger 7. More propane is then evaporated from the kettle product in low pressure evaporator 9.

U.S. Pat. No. 3,516,928 to King et al solvent extracts a heavy hydrocarbon oil with a lower alkane or alkene solvent. The extraction is carried out at super-critical conditions of temperature and pressure.

U.S. Pat. No. 3,714,033 to Somekh et al discloses a continuous solvent extraction-steam distillation process for the recovery of aromatic hydrocarbons having boiling points in the range of about 80 degrees C. to about 175 degrees C. from a feedstock containing aliphatic hydrocarbons and aromatics hydrocarbons.

U.S. Pat. No. 3,714,034 to Kosseim et al discloses a continuous solvent extraction-steam distillation process for the recovery of aromatic hydrocarbons from a mixed feedstock. The feedstock is contacted with a solvent-water mixture at temperatures in the range of about 75 degrees C. to 200 degrees C. and the extract and raffinate streams are separated into their components. Heat for the various distillation zones is partially supplied by heat exchange with the extract and raffinate streams.

U.S. Pat. No. 4,260,476 to Vidueira et al discloses an improvement to a continuous solvent extraction-steam distillation process for the recovery of aromatic hydrocarbons from a feed stream containing aromatic and aliphatic hydrocarbons. The process uses two extractive distillation zones thermally linked to recover heat and solvent, thereby resulting in a heat savings.

SUMMARY OF THE INVENTION

The prior art processes for recovering deasphalting solvents were not energy efficient. They wasted energy (heat). The present invention solves this problem by reducing the amount of energy required to operate a deasphalting solvent recovery process. Thus, the advantage of the present invention is that it saves energy where before energy was being wasted.

Several embodiments of the invention are disclosed. In each embodiment, the primary and secondary recovery systems are integrated so that heat from the recovered primary solvent is used to operate the secondary recovery system.

The first embodiment of the invention is an energy-efficient continuous process for solvent deasphalting a viscous hydrocarbon oil and recovering the solvent, which comprises:

(a) contacting the hydrocarbon oil with a deasphalting solvent under deasphalting conditions of temperature and pressure in a primary fractionator;

(b) withdrawing the primary raffinate from the primary fractionator and feeding the primary raffinate to a secondary fractionator;

(c) contacting the primary raffinate of step (b) with deasphalting solvent under deasphalting conditions of temperature and pressure in the secondary fractionator;

(d) withdrawing the secondary extract from the secondary fractionator and feeding the secondary extract to a secondary fractionator overhead exchanger and then to a secondary high pressure flash tower;

(e) withdrawing asphalt mix from the secondary fractionator and feeding the asphalt mix to an asphalt recover section;

(f) withdrawing the primary extract from the primary fractionator and feeding the primary extract to a primary clarifier operated at conditions above the critical temperature and pressure of the deasphalting solvent;

(g) withdrawing the light phase from the primary clarifier and using the light phase to heat the primary extract from the primary fractionator and then to heat and evaporate deasphalting solvent in the secondary extract of step (d) in a secondary fractionator overhead exchanger;

(h) withdrawing the heavy phase from the primary clarifier and heating said heavy phase to evaporate deasphalting solvent in a primary mix evaporator;

(i) withdrawing the deasphalting solvent vapor from the primary mix evaporator and feeding the deasphalting solvent vapor to a secondary pressure vapor heat exchanger where the deasphalting solvent vapor is condensed;

(j) withdrawing the deasphalting solvent from the secondary pressure vapor heat exchanger and storing the deasphalting solvent in a high pressure solvent accumulator and recycling the deasphalting solvent to the primary fractionator and to the secondary fractionator;

(k) withdrawing the deasphalting solvent vapor from the secondary high pressure flash tower and feeding the deasphalting solvent vapor to a secondary pressure vapor heat exchanger where the deasphalting solvent is condensed and storing the deasphalting solvent in a high pressure solvent accumulator and recycling the deasphalting solvent to the primary fractionator and to the secondary fractionator;

(l) withdrawing the secondary mix from the secondary high pressure flash tower and feeding the secondary mix to the secondary pressure vapor heat exchanger and then to a secondary low pressure flash tower;

(m) withdrawing the secondary mix from the secondary low pressure flash tower and feeding the secondary mix to a secondary reboiler; and (n) withdrawing the deasphalting solvent from the secondary low pressure flash tower and storing the deasphalting solvent in a low pressure solvent accumulator and recycling the deasphalting solvent to the secondary fractionator.

The second embodiment of the invention is an energy-efficient continuous process for solvent deasphalting a viscous hydrocarbon oil and recovering the solvent, which comprises:

(a) contacting the viscous hydrocarbon oil with a deasphalting solvent under deasphalting conditions of temperature and pressure in a primary fractionator;

(b) withdrawing the primary raffinate from the primary fractionator and feeding the primary raffinate to a secondary fractionator;

(c) contacting the primary raffinate of step (b) with a deasphalting solvent under deasphalting conditions of temperature and pressure in the secondary fractionator;

(d) withdrawing the secondary extract from the secondary fractionator and feeding the secondary extract to a secondary fractionator overhead exchanger and then to a secondary high pressure flash tower;

(e) withdrawing asphalt mix from the secondary fractionator and feeding the asphalt mix to an asphalt recovery section;

(f) withdrawing the primary extract from the primary fractionator and feeding the primary extract to a primary steam heater and then to a primary high pressure flash tower where the deasphalting solvent vapor is taken overhead;

(g) withdrawing the primary mix liquid from the primary high pressure flash tower and heating the primary mix liquid in a primary pressure vapor heat exchanger against condensing deasphalting solvent vapor taken overhead from the primary high pressure flash tower;

(h) withdrawing the condensed deasphalting solvent from the primary pressure vapor heat exchanger and storing the deasphalting solvent in a primary high pressure deasphalting solvent accumulator for recycling to the primary fractionator;

(i) withdrawing the primary mix from the primary pressure vapor heat exchanger and feeding the primary mix to a primary low pressure flash tower where the deasphalting solvent vapor is taken overhead;

(j) withdrawing the primary mix from the primary low pressure flash tower and feeding the primary mix to a primary reboiler;

(k) withdrawing the deasphalting solvent vapor from the primary low pressure flash tower and using the heat in the deasphalting solvent vapor to evaporate deasphalting solvent from the secondary extract of step (d) in the secondary fractionator overhead exchanger;

(l) withdrawing the deasphalting solvent vapor that came from the primary low pressure flash tower from the secondary fractionator overhead exchanger and feeding the deasphalting solvent vapor to a primary solvent condenser where the deasphalting solvent vapor is condensed;

(m) withdrawing the deasphalting solvent from the primary solvent condenser and storing the deasphalting solvent in a primary low pressure solvent accumulator and recycling the deasphalting solvent to the primary fractionator;

(n) withdrawing the deasphalting solvent vapor from the secondary high pressure flash tower and feeding the deasphalting solvent vapor to a secondary pressure vapor heat exchanger where the solvent is condensed and storing the deasphalting solvent in a secondary high pressure solvent accumulator and recycling the deasphalting solvent to the secondary fractionator;

(o) withdrawing the secondary mix from the secondary high pressure flash tower and feeding the secondary mix to the secondary pressure vapor heat exchanger where solvent is evaporated by heat exchange against condensing vapors from the secondary high pressure flash tower and then feeding the secondary mix to a secondary low pressure flash tower; and, (p) withdrawing the deasphalting solvent vapor from the secondary low pressure flash tower and condensing the deasphalting solvent vapor in a secondary solvent condenser and storing the deasphalting solvent in a secondary low pressure solvent accumulator and recycling the deasphalting solvent to the secondary fractionator.

The third embodiment of the invention is an energy-efficient continuous process for solvent deasphalting a viscous hydrocarbon oil and recovering the solvent, which comprises:

(a) contacting the viscous hydrocarbon oil with a deasphalting solvent under deasphalting conditions of temperature and pressure in a primary fractionator;

(b) withdrawing the primary raffinate from the primary fractionator and feeding the primary raffinate to a secondary fractionator;

(c) contacting the primary raffinate of step (b) with a deasphalting solvent under deasphalting conditions of temperature and pressure in the secondary fractionator;

(d) withdrawing the secondary extract from the secondary fractionator and feeding the secondary extract to a secondary fractionator overhead exchanger and then to a primary/secondary exchanger and then to a secondary steam heater and then to a secondary clarifier;

(e) withdrawing asphalt mix from the secondary fractionator and feeding the asphalt mix to an asphalt recovery section;

(f) withdrawing the primary extract from the primary fractionator and feeding the primary extract to a primary fractionator overhead exchanger and then to a primary steam heater and then to a primary clarifier operated at conditions above the critical temperature and pressure of the deasphalting solvent;

(g) withdrawing the light phase from the primary clarifier and using the light phase to heat the primary extract of step (f) and then to heat the secondary extract of step (d) in the primary/secondary exchanger;

(h) withdrawing the heavy phase from the primary clarifier and heating the heavy phase to evaporate deasphalting solvent in a primary mix evaporator;

(i) withdrawing the deasphalting solvent vapor from the primary mix evaporator and condensing the deasphalting solvent vapor in a solvent condenser and storing the condensed deasphalting solvent in a solvent accumulator and recycling the deasphalting solvent to the primary fractionator;

(j) withdrawing the deasphalting solvent from the secondary clarifier and using the deasphalting solvent to heat the secondary extract of step (d) in the secondary fractionator overhead exchanger and then recycling the deasphalting solvent to the secondary fractionator;

(k) withdrawing the secondary mix from the secondary clarifier and feeding the secondary mix to a secondary mix evaporator; and, (l) withdrawing the deasphalting solvent vapor from the secondary mix evaporator and condensing the deasphalting solvent vapor in a solvent condenser and storing the condensed deasphalting solvent in the solvent accumulator and recycling the deasphalting solvent to the primary fractionator.

The fourth embodiment of the invention is an energy-efficient continuous process for solvent deasphalting a viscous hydrocarbon oil and recovering the solvent, which comprises:

(a) contacting the viscous hydrocarbon oil with a deasphalting solvent under deasphalting conditions of temperature and pressure in a primary fractionator;

(b) withdrawing the primary raffinate from the primary fractionator and feeding the primary raffinate to a secondary fractionator;

(c) contacting the primary raffinate of step (b) with a deasphalting solvent under deasphalting conditions of temperature and pressure in the secondary fractionator;

(d) withdrawing the secondary extract from the secondary fractionator and feeding the secondary extract to a secondary fractionator overhead exchanger and then to a secondary flash tower;

(e) withdrawing asphalt mix from the secondary fractionator and feeding the asphalt mix to an asphalt recovery section;

(f) withdrawing the primary extract from the primary fractionator and feeding the primary extract to a primary steam heater and then to a primary high pressure flash tower where the deasphalting solvent vapor is taken overhead;

(g) withdrawing the primary mix liquid from the primary high pressure flash tower and heating the primary mix liquid in a primary pressure vapor heat exchanger against condensing deasphalting solvent vapor taken overhead from the primary high pressure flash tower;

(h) withdrawing the condensed deasphalting solvent from the primary pressure vapor heat exchanger and storing the deasphalting solvent in a primary high pressure deasphalting solvent accumulator for recycling to the primary fractionator;

(i) withdrawing the primary mix from the primary pressure vapor heat exchanger and feeding the primary mix to a primary low pressure flash tower where the deasphalting solvent vapor is taken overhead;

(j) withdrawing the primary mix from the primary low pressure flash tower and feeding the primary mix to a primary reboiler;

(k) withdrawing the deasphalting solvent vapor from the primary low pressure flash tower and using the heat in the deasphalting solvent vapor to evaporate deasphalting solvent from the secondary extract of step (d) in the secondary fractionator overhead exchanger;

(l) withdrawing the deasphalting solvent vapor that came from the primary low pressure flash tower from the secondary fractionator overhead exchanger and feeding the deasphalting solvent vapor to a primary solvent condenser where the deasphalting solvent vapor is condensed;

(m) withdrawing the deasphalting solvent from the primary solvent condenser and storing deasphalting solvent in a primary low pressure solvent accumulator and recycling the deasphalting solvent to the primary fractionator; and, (n) withdrawing the deasphalting solvent vapor from the secondary flash tower and condensing the deasphalting solvent vapor in a secondary solvent condenser and storing the condensed deasphalting solvent in a secondary solvent accumulator and recycling the deasphalting solvent to the secondary fractionator.

The fifth embodiment of the invention is an energy-efficient continuous process for solvent deasphalting a viscous hydrocarbon oil and recovering the solvent, which comprises:

(a) contacting the viscous hydrocarbon oil with a deasphalting solvent under deasphalting conditions of temperature and pressure in a primary fractionator;

(b) withdrawing the primary raffinate from the primary fractionator and feeding the primary raffinate to a secondary fractionator;

(c) contacting the primary raffinate of step (b) with a deasphalting solvent under deasphalting conditions of temperature and pressure in the secondary fractionator;

(d) withdrawing the secondary extract from the fractionator and feeding the secondary extract to a secondary fractionator overhead exchanger and then to a secondary high pressure flash tower;

(e) withdrawing asphalt mix from the secondary fractionator and feeding the asphalt mix to an asphalt recovery section;

(f) withdrawing the primary extract from the primary fractionator and feeding the primary extract to a primary steam heater and then to a primary flash tower where the deasphalting solvent vapor is taken overhead;

(g) withdrawing the primary mix from the primary flash tower and feeding the primary mix to a primary reboiler;

(h) withdrawing the deasphalting solvent vapor from the primary flash tower and using the heat in the deasphalting solvent to evaporate deasphalting solvent from the secondary extract of step (d) in the secondary fractionator overhead exchanger;

(i) withdrawing the deasphalting solvent vapor that came from the primary flash tower from the secondary fractionator overhead exchanger and feeding the deasphalting solvent vapor to a primary solvent condenser where the deasphalting solvent vapor is condensed;

(j) withdrawing the deasphalting solvent from the primary solvent condenser and storing the deasphalting solvent in a primary low pressure solvent accumulator and recycling the deasphalting solvent to the primary fractionator;

(k) withdrawing the deasphalting solvent vapor from the secondary high pressure flash tower and condensing the deasphalting solvent vapor in the secondary pressure vapor heat exchanger and storing the condensed deasphalting solvent in a secondary high pressure solvent accumulator and recycling the deasphalting solvent to the secondary fractionator;

(l) withdrawing the secondary mix from the secondary high pressure flash tower and evaporating solvent in the secondary mix by heat exchange with the solvent vapor from the secondary high pressure flash tower in the secondary pressure vapor heat exchanger and feeding the secondary mix to a secondary low pressure flash tower where the evaporated solvent is taken overhead; and, (m) withdrawing the deasphalting solvent vapor from the secondary low pressure flash tower and condensing the vapor in a solvent condenser and storing the deasphalting solvent in a secondary low pressure solvent accumulator and recycling deasphalting solvent to the secondary fractionator.

The sixth embodiment of the invention is an energy-efficient continuous process for solvent deasphalting a viscous hydrocarbon oil and recovering the solvent, which comprises:

(a) contacting the viscous hydrocarbon oil with a deasphalting solvent under deasphalting conditions of temperature and pressure in a primary fractionator;

(b) withdrawing the primary raffinate from the primary fractionator and feeding the primary raffinate to a secondary fractionator;

(c) contacting the primary raffinate of step (b) with a deasphalting solvent under deasphalting conditions of temperature and pressure in the secondary fractionator;

(d) withdrawing the secondary extract from the secondary fractionator and feeding the secondary extract to a secondary fractionator overhead exchanger and then to a secondary flash tower;

(e) withdrawing asphalt mix from the secondary fractionator and feeding the asphalt mix to an asphalt recovery section;

(f) withdrawing the primary extract from the primary fractionator and feeding the primary extract to a primary steam heater where solvent in the primary extract is vaporized and then feeding the primary extract to a primary flash tower where the deasphalting solvent vapor is taken overhead;

(g) withdrawing the primary mix from the primary flash tower and feeding the primary mix to a primary reboiler;

(h) withdrawing the deasphalting solvent vapor from the primary flash tower and using the heat in the deasphalting solvent vapor to evaporate deasphalting solvent from the secondary extract of step (d) in the secondary overhead exchanger;

(i) withdrawing the deasphalting solvent vapor that came from the primary flash tower from the secondary fractionator overhead exchanger and feeding the deasphalting solvent vapor to a primary solvent condenser where the deasphalting solvent vapor is condensed;

(j) withdrawing the deasphalting solvent from the primary solvent condenser and storing the deasphalting solvent in a primary solvent accumulator and recycling the deasphalting solvent to the primary fractionator; and, (k) withdrawing the deasphalting solvent vapor from the secondary flash tower and condensing the deasphalting solvent in a secondary solvent condenser and storing the deasphalting solvent in a secondary solvent accumulator and recycling the deasphalting solvent to the secondary fractionator.

And finally the seventh embodiment of the invention is an energy-efficient continuous process for solvent deasphalting a viscous hydrocarbon oil and recovering the solvent, which comprises:

(a) contacting the viscous hydrocarbon oil with a deasphalting solvent under deasphalting conditions of temperature and pressure in a primary fractionator;

(b) withdrawing the primary raffinate from the primary fractionator and feeding the primary raffinate to a secondary fractionator;

(c) contacting the primary raffinate of step (b) with a deasphalting solvent under deasphalting conditions of temperature and pressure in the secondary fractionator;

(d) withdrawing the secondary extract from the secondary fractionator and feeding the secondary extract to a secondary fractionator overhead exchanger and then to a secondary flash tower;

(e) withdrawing asphalt mix from the secondary fractionator and feeding the asphalt mix to an asphalt recovery section;

(f) withdrawing the primary extract from the primary fractionator and feeding the primary extract to a primary fractionator overhead exchanger and then to a primary steam heater and then to a primary clarifier operated at conditions above the critical temperature and pressure of the deasphalting solvent;

(g) withdrawing the light phase from the primary clarifier and using the light phase to heat and evaporate deasphalting solvent in the secondary extract of step (d) in the secondary fractionator overhead exchanger;

(h) withdrawing the heavy phase from the primary clarifier and heating the heavy phase to evaporate deasphalting solvent in a primary mix evaporator;

(i) withdrawing the deasphalting solvent vapor from the primary mix evaporator and feeding the deasphalting solvent vapor to a secondary solvent condenser where the deasphalting solvent vapor is condensed;

(j) withdrawing the deasphalting solvent from the secondary solvent condenser and storing the deasphalting solvent in a secondary solvent accumulator and recycling the deasphalting solvent to the secondary fractionator;

(k) withdrawing the deasphalting solvent vapor from the secondary flash tower and feeding the deasphalting vapor to the secondary solvent condenser where the deasphalting solvent vapor is condensed; and, (l) withdrawing the deasphalting solvent from the secondary solvent condenser and storing the deasphalting solvent in the secondary solvent accumulator and recycling the deasphalting solvent to the secondary fractionator.

Figure 1A:
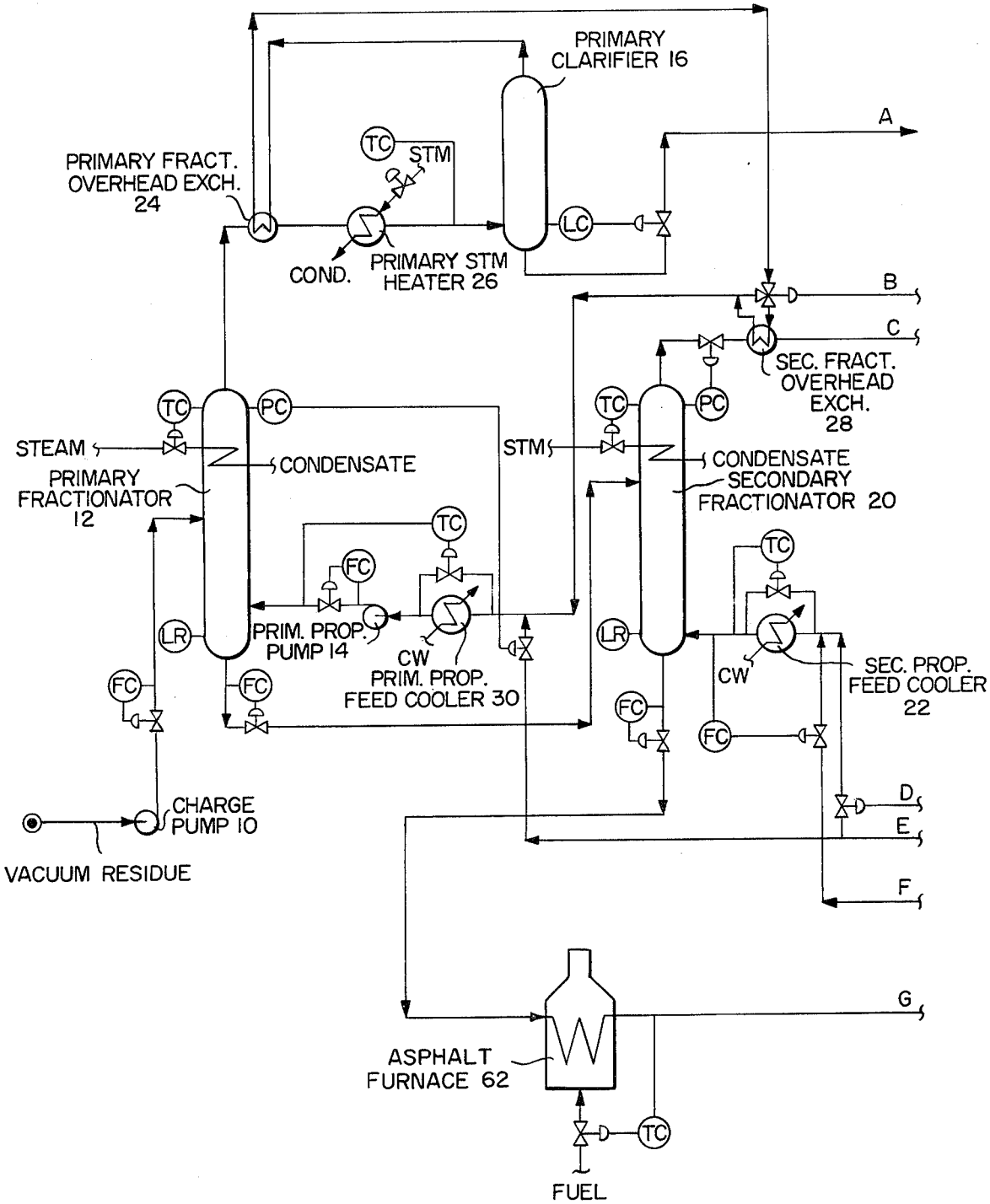
FIGS. 1*a* and 1*b* are a schematic flow diagram of a first embodiment of the present invention. The flow diagram is divided for convenience into a and b portions with connecting points A, B, C, D, E, and F as shown.

In the drawings, CW represents cooling water, TC represents temperature control, FC represents flow control, PC represents pressure control, and LC represents level control.

DESCRIPTION OF THE PREFERRED EMBODIMENTS

The invention is an energy-efficient improvement in a continuous deasphalting process in which a mixture of viscous hydrocarbon oils with resins and/or asphaltenes is contacted with a quantity of pure or mixed hydrocarbon solvents including, but not limited to, propane, butane, pentane, hexane, heptane, isomers thereof, and unsaturated hydrocarbons of similar molecular weights, in order to separate a primary extract phase comprising high viscosity oil, resins and/or asphaltenes, and solvent. The primary raffinate phase is further contacted with an additional quantity of solvent comprising similar components to those in the primary solvent (but not necessarily identical thereto) to separate a secondary extract phase comprising high viscosity oil and solvent, and a secondary raffinate phase comprising resins and/or asphaltenes and solvent. The contacting step may be repeated as often as desired to make additional extract phases which are recovered separately. The solvents from the extract and raffinate phases are separated from the associated viscous oils, resins and/or asphaltenes, and reused in the contacting process.

I. First Embodiment

The process flow for a representative propane deasphalting unit illustrating the first embodiment is described below and is depicted schematically in the process flow diagram of FIGS. 1*a* and 1*b*. The temperatures and pressures are illustrative of a continuously operating propane deasphalting unit.

Charge Circuit

Figure 1B:
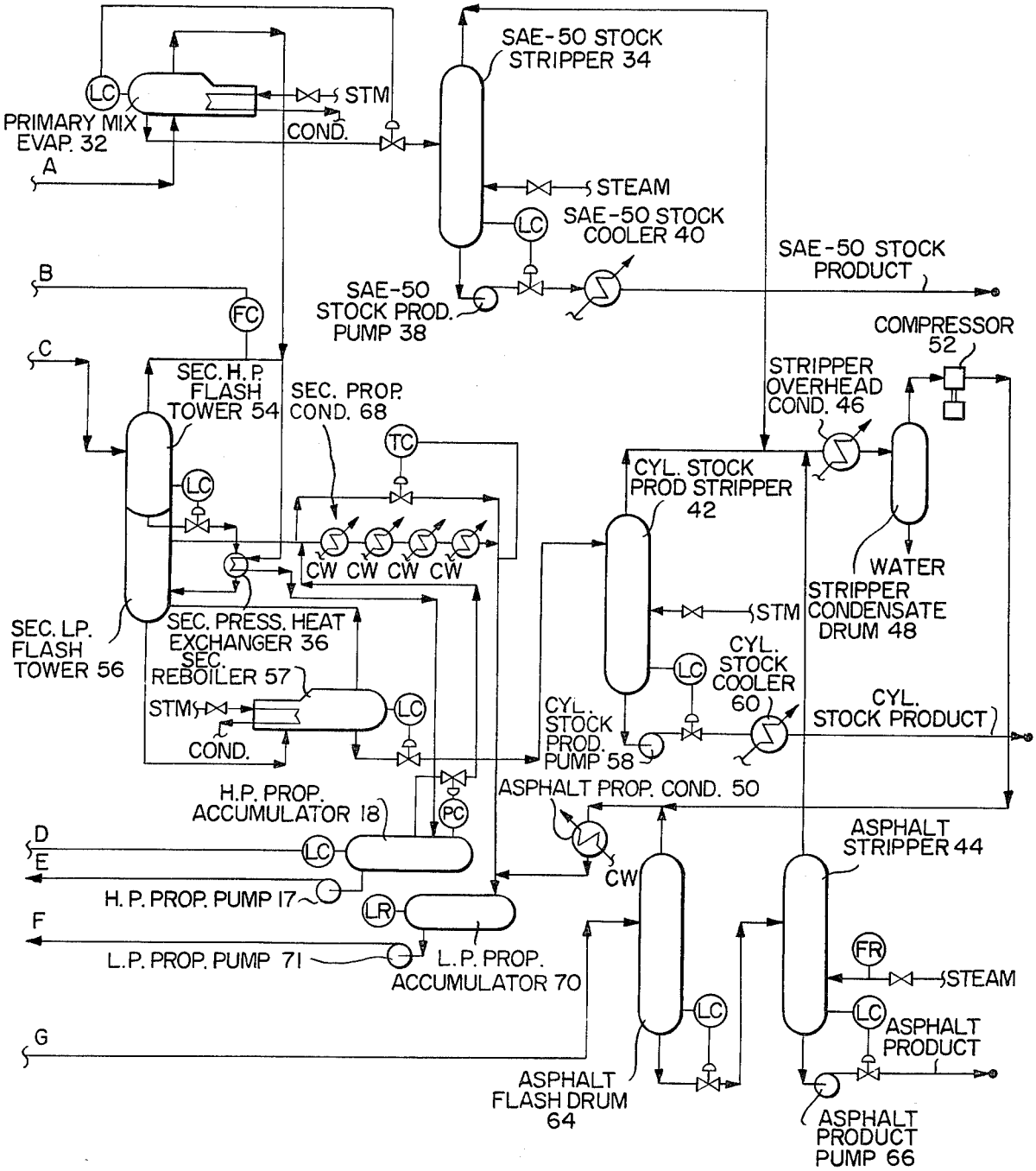

Referring to FIGS. 1*a* and 1*b*, vacuum residue at 185 degrees F. is pumped from storage by the charge oil pump 10 under flow control to the primary fractionator 12. Propane at 148 degrees F. from the primary propane pump 14 enters the bottom of the primary fractionator 12 under flow control and flows upward countercurrent to the downcoming oil charge, thereby extracting SAE-50 oil stock from the vacuum residue. The pressure of 635 psia in the primary fractionator 12 and the pressure of 625 psia in primary clarifier 16 are maintained by adding propane (pumped by high pressure propane pump 17) from the high pressure propane accumulator 18. Raffinate at 148 degrees F. from the bottom of the primary fractionator 12 containing cylinder oil stock, asphalt, and propane is withdrawn under flow control and fed to the secondary fractionator 20 where the pressure is 465 psia.

Propane at 112 degrees F. from the secondary propane feed cooler 22 enters the bottom of the secondary fractionator 20 under flow control and flows upward countercurrent to the downcoming oil. Asphalt mix at 112 degrees F. is withdrawn under flow control from the bottom of the secondary fractionator 20 and sent to the asphalt recovery section. Steam coils in the upper section of the primary fractionator 12 and of the secondary fractionator 20 maintain a temperature gradient in each fractionator to improve separation between SAE-50 oil stock and cylinder oil stock and between cylinder oil stock and asphalt.

Primary SAE-50 Oil Stock

The primary SAE-50 oil stock/propane mix at 180 degrees F. from the top of the primary fractionator 12 is heated to 202 degrees F. by heat exchange against the light phase (at 210 degrees F.) from the primary clarifier 16 in the primary fractionator overhead exchanger 24. The primary SAE-50 mix is further heated to the operating temperature of 210 degrees F. of the primary clarifier 16 by low pressure steam in the primary steam heater 26. The operating conditions of 625 psia and 210 degrees F. in the primary clarifier 16 are above the critical temperature and pressure of the propane solvent.

In the primary clarifier 16, the propane density is low enough to allow a propane-rich light phase with a low oil content to separate from a heavier oil-rich phase. The light phase at 210 degrees F. is used to heat partially the primary SAE-50 oil stock/propane mix in the primary fractionator overhead exchanger 24 and then at 205 degrees F. to evaporate propane from the secondary cylinder oil stock/propane mix in the secondary fractionator overhead exchanger 28 before being cooled from 176 degrees F. to 148 degrees F. in the primary propane feed cooler 30 and returned to the primary fractionator 12 by the primary propane pump 14. The heavy phase (at 210 degrees F. and 625 psia) is withdrawn under flow control from the primary clarifier 16 and heated with steam to 266 degrees F. at a lower pressure of 340 psia to evaporate propane in the primary mix evaporator 32. This reduces the amount of solvent carried to the SAE-50 oil stock stripper 34.

Propane vaporized in the primary SAE-50 oil mix evaporator 32 is sent to the secondary pressure vapor heat exchanger 36. SAE-50 oil stock and some propane exit from the primary mix evaporator 32 under level control and enter the SAE-50 oil stripper 34 on the top tray at 266 degrees F. and 18 psia. The remaining propane is steam stripped from the SAE-50 stock by steam at 400 degrees F. entering below the bottom tray. SAE-50 oil stock product at 239 degrees F. is pumped by SAE-50 stock product pump 38 under level control from the stripper 34 and cooled to 150 degrees F. in the SAE-50 oil stock cooler 40 before being sent to battery limits.

Propane and steam from the SAE-50 oil stock stripper 34 are combined with the overheads from the cylinder stock product stripper 42 and the asphalt stripper 44 and enter the stripper overhead condenser 46 where the steam is condensed. Propane vapor is separated from the condensed water in the stripper condensate drum 48 and returned to the asphalt propane condenser 50 by the compressor 52.

Secondary Cylinder Oil Stock

The secondary cylinder oil stock/propane mix leaves the top of the secondary fractionator 20 at 152 degrees F. and flows to the secondary recovery system. The pressure of 465 psia at the top of the secondary fractionator 20 is maintained by a back pressure control valve. A portion of the propane in the secondary cylinder stock/propane mix is evaporated by exchange against the light phase from the primary clarifier 16 in the secondary fractionator overhead exchanger 28. The mix then flows into the secondary high pressure flash tower 54 at 152 degrees F. and 340 psia where propane vapor is taken overhead. The remaining secondary mix is held under level control in the bottom of this tower 54. The liquid mix flows through a level control valve, where the reduction in pressure permits further vaporization.

The two-phase mixture is then heated in secondary pressure vapor heat exchanger 36 against condensing propane vapor from the secondary high pressure flash tower 54 and the primary mix evaporator 32. The condensed propane flows to the high-pressure propane accumulator 18 at 148 degrees F. and 330 psia. The secondary mix flows from secondary pressure vapor heat exchanger 36 to the secondary low pressure flash tower 56 at 127 degrees F. and 232 psia, where again propane vapor is taken overhead. The remaining secondary mix liquid flows down the tower and is heated by rising propane vapors at 260 degrees F. from the secondary reboiler 57. This heat exchange is effected on two contacting trays in the tower 56. The secondary mix leaving the tower 56 flows to the secondary reboiler 57 where it is heated by steam to 260 degrees F. at 232 psia. Evaporated propane returns to the secondary low pressure flash tower 56 below the bottom tray. From the secondary reboiler 57 the remaining secondary mix flows under level control to the top tray of the cylinder stock product stripper 42 at 260 degrees F. and 18 psia. The remaining propane is stripped overhead with steam at 400 degrees F. which enters the cylinder stock product stripper 42 below the bottom tray. The cylinder stock product at 233 degrees F. is pumped by cylinder stock product pump 58 from the tower bottom under level control and is cooled to 200 degrees F. in the cylinder stock cooler 60 before flowing to battery limits.

Secondary fractionator overhead exchanger 28 is an innovation which integrates the primary (SAE-50 oil stock) and secondary (cylinder oil stock) recovery systems so that heat from the recovered primary solvent is used to operate the secondary recovery system. This exchanger 28 reduces the heating requirement by 37 percent and the cooling requirement by 27 percent of the values needed if the two systems were operated independently.

Asphalt Recovery

The asphalt raffinate at 112 degrees F. from the secondary fractionator 20 is flow controlled through the asphalt mix heater 62. The hot, two-phase asphalt mix at 425 degrees F. from the heater 62 flows to the asphalt mix flash drum 64 (at 425 degrees F. and 232 psia) where propane is taken overhead. The remaining asphalt mix flows to the asphalt stripper 44 under level control and enters the stripper on the top tray at 425 degrees F. and 18 psia. Steam at 400 degrees F. entering below the bottom tray is used to strip the remaining propane from the asphalt and the wet propane vapor overhead combines with the overhead from the SAE-50 stock and cylinder stock strippers 34 and 42. The asphalt product at 383 degrees F. is pumped out by asphalt product pump 66 under level control to the battery limits.

Solvent System

Propane flashed in the secondary low pressure flash tower 56 is condensed in the secondary propane condenser 68 and flows to the low pressure propane accumulator 70 at 115 degrees F. and 221 psia. Propane from the asphalt flash drum 64 which operates at 425 degrees F. and 232 psia is condensed in a separate asphalt propane condenser 50 and flows to the low pressure propane accumulator 70.

Makeup propane is pumped from offsite propane storage to the low pressure propane accumulator 70 as required.

II. Second Embodiment

The process flow for a representative propane deasphalting unit illustrating the second embodiment is described below and is depicted schematically in the process flow diagram of FIGS. 2*a* and 2*b*. The temperatures and pressures are illustrative of a continuously operating propane deasphalting unit.

Charge Circuit

Figure 2A:
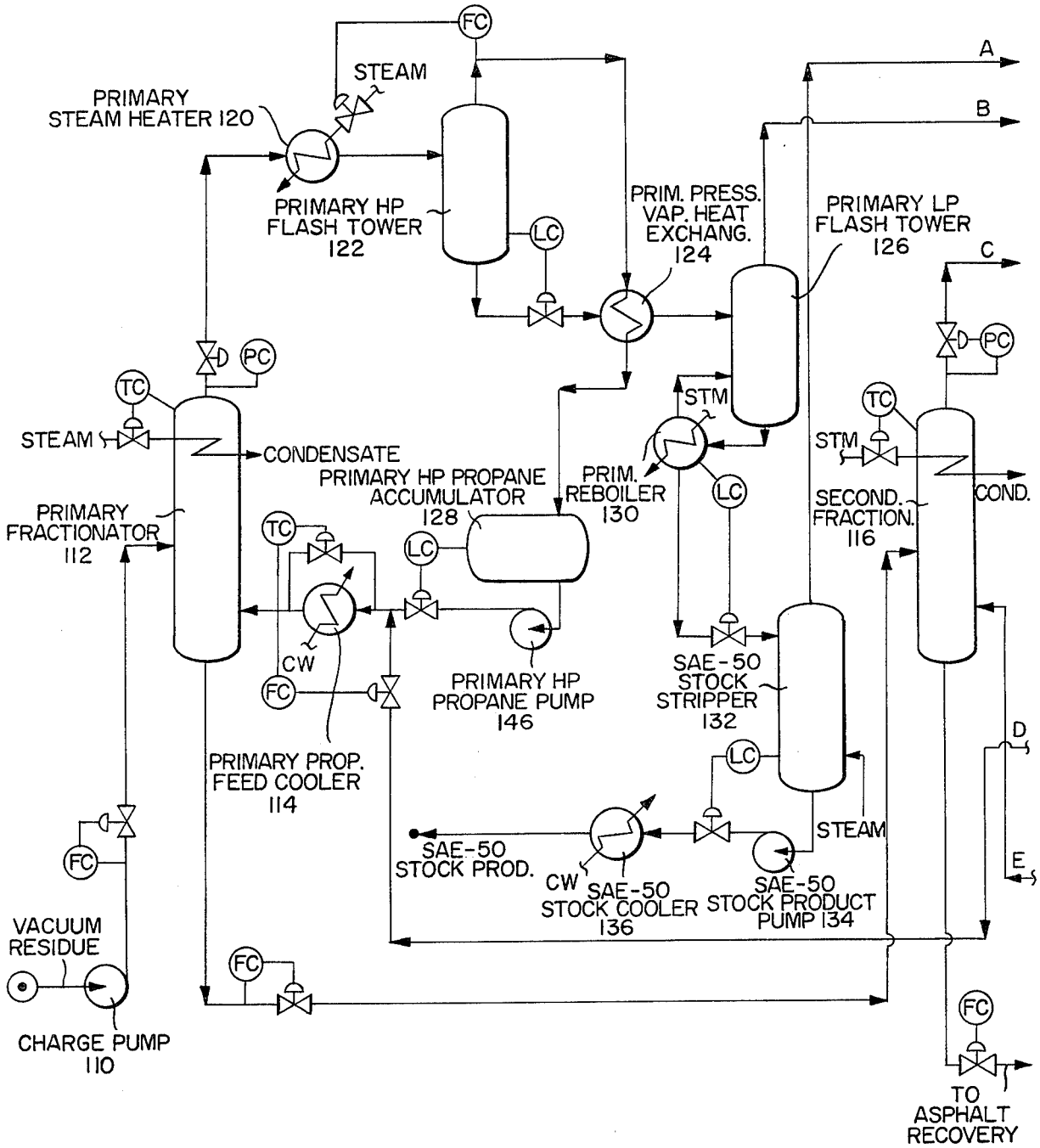
FIGS. 2*a* and 2*b* are a schematic flow diagram of a second embodiment of the present invention. The flow diagram is divided for convenience into a and b portions with connecting points A, B, C, D, and E as shown.
Figure 2B:
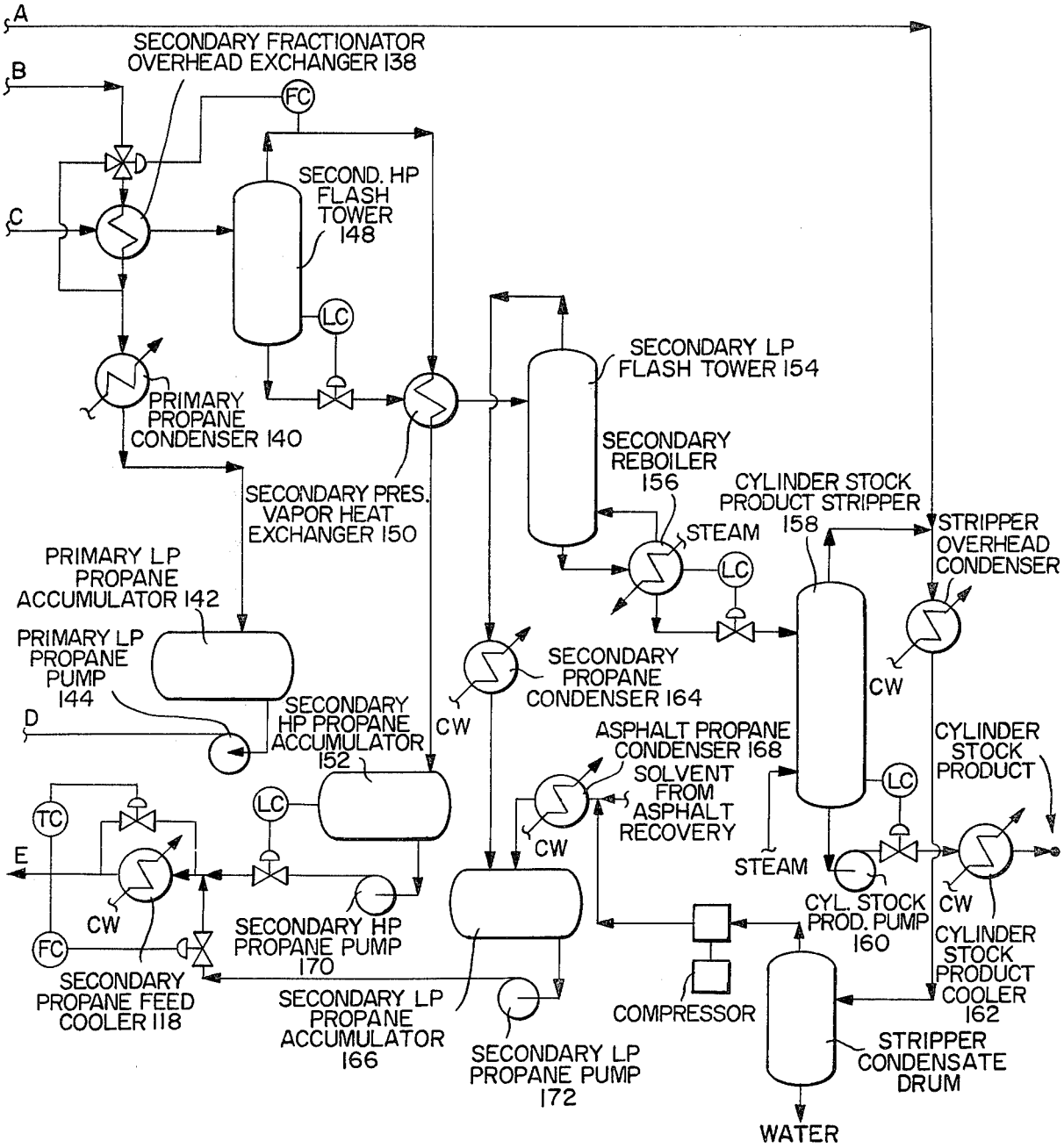

Referring to FIGS. 2*a* and 2*b*, vacuum residue at 185 degrees F. is pumped from storage by the charge oil pump 110 under flow control to the primary fractionator 112. Propane at 148 degrees F. from the primary propane feed cooler 114 enters the bottom of the primary fractionator 112 and flows upward countercurrent to the downcoming oil charge, thereby extracting SAE-50 oil stock from the vacuum residue. The pressure in the primary fractionator 112 is 635 psia. Raffinate at 148 degrees F. from the bottom of the primary fractionator 112 containing cylinder oil stock, asphalt, and propane is withdrawn under flow control and fed to the secondary fractionator 116 where the pressure is 465 psia.

Propane from the secondary propane feed cooler 118 enters the bottom of the secondary fractionator 116 and flows upward countercurrent to the downcoming oil. Asphalt mix is withdrawn under flow control from the bottom of the secondary fractionator 116 and sent to the asphalt recovery section. Steam coils in the upper section of fractionators 112 and 116 maintain a temperature gradient in each fractionator to improve separation between SAE-50 oil stock and cylinder oil stock and between cylinder oil stock and asphalt.

Primary SAE-50 Oil Stock

The primary SAE-50 oil stock/propane mix at 180 degrees F. leaves the top of the primary fractionator 112 and flows to the primary recovery system. The pressure of 635 psia at the top of the primary fractionator 112 is maintained by a back pressure control valve. A portion of the propane in the primary SAE-50 oil stock/propane mix is evaporated by condensing steam in the primary steam heater 120. The mix then flows into the primary high pressure flash tower 122 (at 198 degrees F. and 555 psia) where propane vapor is taken overhead. The remaining primary mix liquid is held under level control in the bottom of this tower 122.

The liquid mix flows through the level control valve, where the reduction in pressure permits some further vaporization. The two-phase mixture is then heated in primary pressure vapor heat exchanger 124 against condensing propane vapor from the primary high pressure flash tower 122. The condensed propane flows to the primary high pressure propane accumulator 128 (at 193 degrees F. and 540 psia).

The primary mix flows from primary pressure vapor heat exchanger 124 to the primary low pressure flash tower 126 (at 173 degrees F. and 381 psia) where again propane vapor is taken overhead. The remaining primary mix liquid flows down the tower 126 and is heated by rising propane vapors from the primary reboiler 130. This heat exchange is effected on two contacting trays in the tower 126. The primary mix leaving the tower 126 flows to the primary reboiler 130 where it is heated by steam. Evaporated propane returns to the primary low pressure flash tower 126 below the bottom tray.

From the primary reboiler 130, the remaining primary mix (at 260 degrees F.) flows under level control to the top tray of SAE-50 stock stripper 132 (at 260 degrees F. and 18 psia). The remaining propane is stripped overhead with steam which enters the SAE-50 stock stripper 132 below the bottom tray. The SAE-50 product is pumped by the SAE-50 stock product pump 134 from the tower bottom under level control and is cooled to 150 degrees F. in the SAE-50 stock cooler 136 before flowing to battery limits.

Propane vapor from the primary low pressure flash tower 126 is partially condensed in the secondary fractionator overhead exchanger 138 to evaporate propane from the cylinder stock/propane mix. The remaining propane vapor (at 165 degrees F.) is condensed in the primary propane condenser 140 and collected in the primary low pressure propane accumulator 142 (at 148 degrees F. and 330 psia). Propane is pumped by primary low pressure propane pump 144 from primary low pressure propane accumulator 142, combined with propane (at 193 degrees F.) pumped by primary high pressure propane pump 146 from primary high pressure propane accumulator 128 and cooled (to 148 degrees F.) in the primary propane feed cooler 114 before returning to the primary fractionator 112.

Secondary Cylinder Oil Stock

The secondary cylinder stock/propane mix at 152 degrees F. leaves the top of the secondary fractionator 116 and flows to the secondary recovery system. The pressure of 465 psia at the top of the secondary fractionator 116 is maintained by a back pressure control valve. A portion of the propane in the secondary cylinder stock/propane mix is evaporated by heat exchange against condensing propane from the primary low pressure flash tower 126 in the secondary fractionator overhead exchanger 138.

The mix then flows into the secondary high pressure flash tower 148 (at 152 degrees F. and 340 psia) where propane vapor is taken overhead. The remaining secondary mix is held under level control in the bottom of this tower 148. The liquid mix flows through the level control valve, where the reduction in pressure permits further vaporization. The two-phase mixture is then heated in the secondary pressure vapor heat exchanger 150 against condensing propane vapor from the secondary high pressure flash tower 148.

The condensed propane flows to the secondary high pressure propane accumulator 152 (at 148 degrees F. and 330 psia). The secondary mix flows from the secondary pressure vapor heat exchanger 150 to the secondary low pressure flash tower 154 (at 127 degrees F. and 232 psia) where again propane vapor is taken overhead. The remaining secondary mix liquid flows down the tower 154 and is heated by rising propane vapors from the secondary reboiler 156. This heat exchange is effected on two contacting trays in the tower 154. The secondary mix leaving the tower 154 flows to the secondary reboiler 156 where it is heated by steam to 260 degrees F. Evaporated propane returns to the secondary low pressure flash tower 154 below the bottom tray. From the secondary reboiler 156, the remaining secondary mix (at 260 degrees F.) flows under level control to the top tray of cylinder stock product stripper 158 (at 260 degrees F. and 18 psia). The remaining propane is stripped overhead with steam which enters the cylinder stock product stripper 158 below the bottom tray. The cylinder stock product is pumped by cylinder stock product pump 160 from the tower 158 bottom under level control and is cooled to 200 degrees F. in the cylinder stock product cooler 162 before flowing to battery limits.

Propane flashed in the secondary low pressure flash tower 154 is condensed in the secondary propane condenser 164 and flows to the secondary low pressure propane accumulator 166 (at 115 degrees F. and 221 psia). Propane from the asphalt flash drum (not shown), which operates at the same pressure (221 psia), is condensed in a separate asphalt propane condenser 168 and flows to the secondary low pressure propane accumulator 166. Propane is pumped by secondary high pressure propane pump 170 from secondary high pressure propane accumulator 152, combined with propane pumped by secondary low pressure propane pump 172 from secondary low pressure propane accumulator 166 and cooled in the secondary propane feed cooler 118 before returning to the secondary fractionator 116.

Makeup propane is pumped from offsite propane storage to the primary low pressure propane accumulator 142 as required.

Secondary fractionator overhead exchanger 138 is an innovation which integrates the primary (SAE-50 oil stock) and secondary (cylinder oil stock) recovery systems so that waste heat in the vapor from the primary low pressure flash tower 126 is used to operate the secondary recovery system. This exchanger reduces the heating requirement by 35 percent and the cooling requirement by 28 percent of the values needed if the two systems were operated independently.

Asphalt Recovery (Not Shown)

The flow of asphalt raffinate from the secondary fractionator 116 is the same as described above for the first embodiment, which is shown in the process flow diagram of FIGS. 1*a* and 1*b*.

III. Third Embodiment

The process flow for a representative propane deasphalting unit illustrating the third embodiment is described below and is depicted schematically in the process flow diagram of FIGS. 3*a* and 3*b*. The temperatures and pressures are illustrative of a continuously operating propane deasphalting unit.

Charge Circuit

Figure 3A:
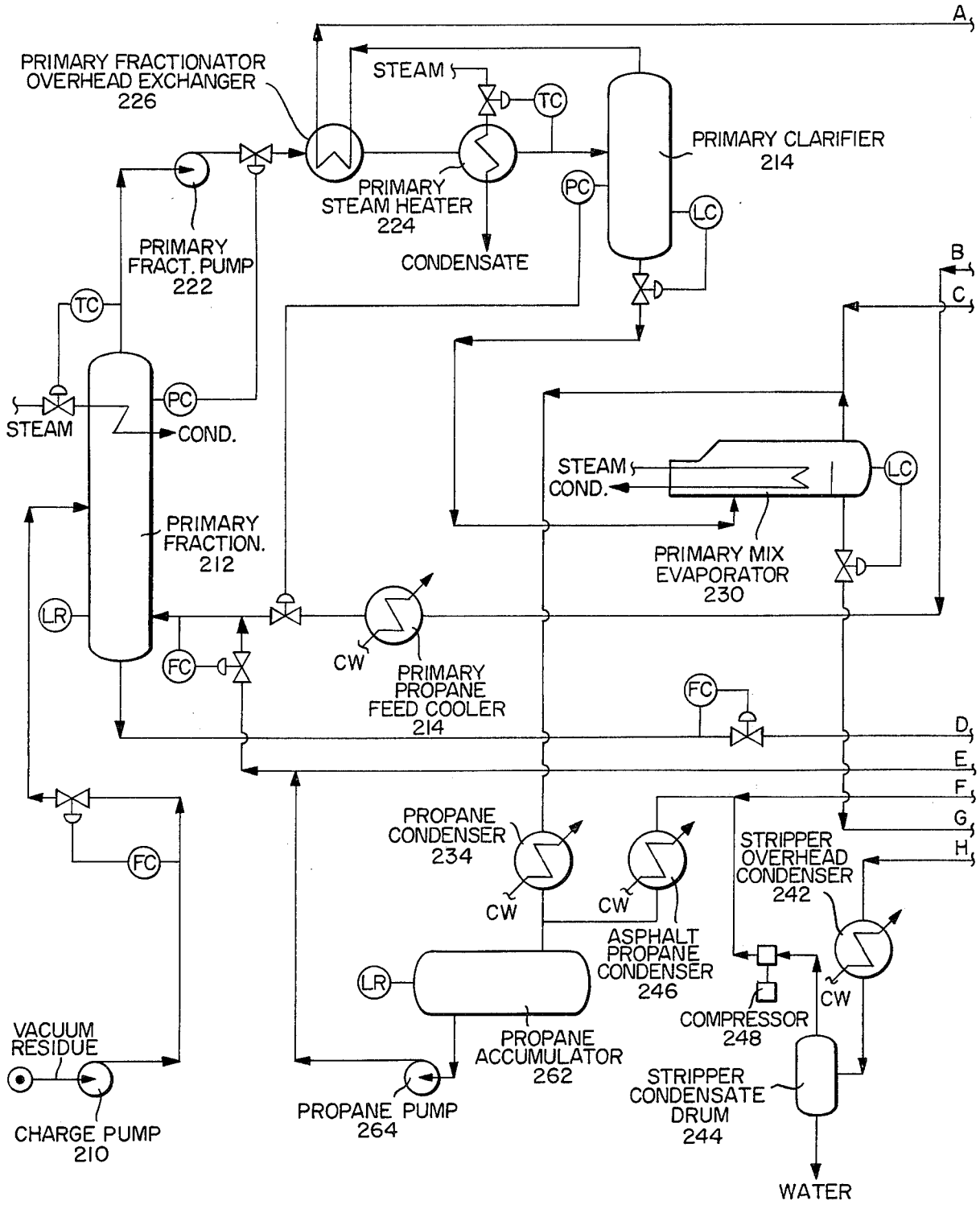
FIGS. 3*a* and 3*b* are a schematic flow diagram of a third embodiment of the present invention. The flow diagram is divided for convenience into a and b portions with connecting points A, B, C, D, E, F, G, and H as shown.
Figure 3B:
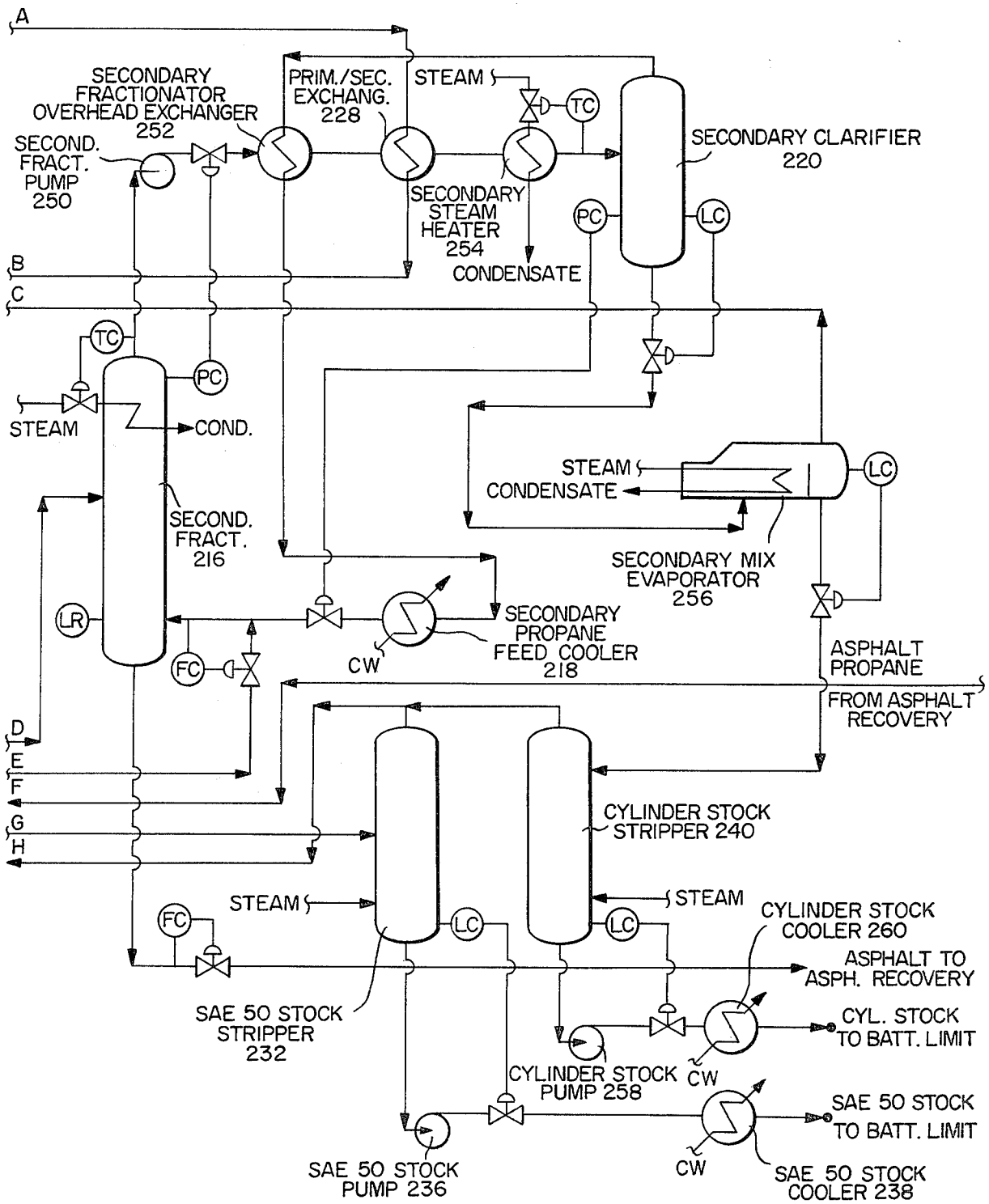

Referring to FIGS. 3*a* and 3*b*, vacuum residue at 185 degrees F. is pumped from storage by the charge oil pump 210 under flow control to the primary fractionator 212. Propane (at 148 degrees F. and 650 psia) from the primary propane feed cooler 214 enters the bottom of the primary fractionator 212 under flow control and flows upward countercurrent to the downcoming oil charge, thereby extracting SAE-50 oil stock from the vacuum residue. The pressure of 635 psia in the primary fractionator 212 is maintained by limiting the rate of extract phase removal from the primary fractionator 212 and the pressure of 740 psia in the primary clarifier 214 is maintained by limiting the rate of light phase removal from the primary clarifier 214. Raffinate from the bottom of the primary fractionator 212 containing cylinder oil stock, asphalt, and propane is withdrawn under flow control and fed to the secondary fractionator 216.

Propane (at 112 degrees F. and 480 psia) from the secondary propane feed cooler 218 enters the bottom of the secondary fractionator 216 under flow control and flows upward countercurrent to the downcoming oil. Pressure control in the secondary fractionator 216 and secondary clarifier 220 is maintained by the same method used in the primary system. Asphalt mix (at 112 degrees F.) is withdrawn under flow control from the bottom of the secondary fractionator 216 and sent to the asphalt recovery section. Steam coils in the upper section of fractionators 212 and 216 maintain a temperature gradient in each fractionator to improve separation between SAE-50 oil stock and cylinder oil stock and between cylinder oil stock and asphalt.

Primary SAE-50 Oil Stock

The primary SAE-50 oil stock/propane mix (at 180 degrees F. and 635 psia) is pumped by primary fractionator pump 222 from the top of the primary fractionator 212 and is heated to 215 degrees F. by heat exchange against the light phase from the primary clarifier 214 in the primary fractionator overhead exchanger 226. The primary SAE-50 mix is further heated to the operating temperature (238 degrees F.) of the primary clarifier 214 by low pressure steam in the primary steam heater 224. The operating conditions (of 238 degrees F. and 740 psia) in the primary clarifier 214 are above the critical temperature and pressure of the propane solvent.

In the primary clarifier 214, the propane density is low enough to allow a propane-rich light phase with a low oil content to separate from a heavier oil-rich phase. The light phase (at 238 degrees F.) is used to heat partially the primary SAE-50 oil stock/propane mix in the primary fractionator overhead exchanger 226 and then the light phase (now at 216 degrees F.) is used to heat the secondary cylinder oil stock/propane mix in the primary/secondary exchanger 228 before being cooled (from 206 degrees F. to 148 degrees F.) in the primary propane feed cooler 214 and returned to the primary fractionator 212. The heavy phase is withdrawn under level control from the primary clarifier 214 and heated at a lower pressure with steam to evaporate propane in the primary mix evaporator 230 (at 266 degrees F. and 340 psia). This reduces the amount of solvent carried to the SAE-50 stripper 232. Propane vaporized in the primary SAE-50 mix evaporator 230 is condensed in the propane condenser 234.

SAE-50 oil stock and some propane exit from the primary mix evaporator 230 under level control and enter the SAE-50 stock stripper 232 on the top tray (at 266 degrees F. and 18 psia). The remaining propane is steam stripped from the SAE-50 stock by steam (at 400 degrees F.) entering below the bottom tray. SAE-50 stock product (at 237 degrees F.) is pumped by SAE-50 stock product pump 236 under level control from the stripper and cooled to 150 degrees F. in the SAE-50 stock cooler 238 before being sent to battery limits.

Propane and steam from the SAE-50 stripper 232 are combined with the overheads from the cylinder oil stock stripper 240 and the asphalt stripper (not shown) and enter the stripper overhead condenser 242 where the steam is condensed. Propane vapor is separated from the condensed water in the stripper condensate drum 244 and returned to the asphalt propane condenser 246 by the compressor 248.

Secondary Cylinder Oil Stock

The secondary cylinder oil stock/propane mix (at 152 degrees F. and 465 psia) is pumped by secondary fractionator pump 250 from the top of the secondary fractionator 216, heated to 200 degrees F. by heat exchange against the light phase from the secondary clarifier 220 in the secondary fractionator overhead exchanger 252 and is then further heated to 206 degrees F. by heat exchange against the light phase (at 216 degrees F.) from the primary clarifier 214 in the primary/secondary exchanger 228. The secondary cylinder stock mix is further heated to the operating temperature (210 degrees F.) of the secondary clarifier 220 by low pressure steam in the secondary steam heater 254. The operating conditions (of 210 degrees F. and 625 psia) in the secondary clarifier 220 are above the critical temperature and pressure of the propane solvent.

In the secondary clarifier 220, the propane density is low enough to allow a propane-rich light phase with a low oil content to separate from a heavier oil-rich phase. The light phase (at 210 degrees F.) is used to heat partially the secondary cylinder stock/propane mix in the secondary fractionator overhead exchanger 252 before being cooled (from 195 degrees F. to 112 degrees F.) in the secondary propane feed cooler 218 and returned (at 112 degrees F. and 480 psia) to the secondary fractionator 216. The heavy phase is withdrawn under level control from the secondary clarifier 220 and heated at a lower pressure with steam to evaporate propane in the secondary mix evaporator 256 (at 260 degrees F. and 340 psia). This reduces the amount of solvent carried to the cylinder stock stripper 240.

Propane vaporized in the secondary mix evaporator 256 is condensed in the propane condenser 234. Cylinder oil stock and some propane exit from the secondary mix evaporator 256 under level control and enter the cylinder stock stripper 240 on the top tray (at 260 degrees F. and 18 psia). The remaining propane is steam stripped from the cylinder oil stock by steam (at 400 degrees F.) entering below the bottom tray. Cylinder oil stock product (at 233 degrees F.) is pumped by the cylinder stock product pump 258 under level control from the stripper and cooled to 200 degrees F. in the cylinder stock cooler 260 before being sent to battery limits.

Propane and steam from the cylinder stock stripper 240 are combined with the overheads from SAE-50 stripper 232 and the asphalt stripper (not shown) and enter the stripper overhead condenser 242 where the steam is condensed. Propane vapor is separated from the condensed water in the stripper condensate drum 244 and returned to the asphalt propane condenser 246 by the compressor 248.

Primary/secondary exchanger 228 is an innovation which integrates the primary (SAE-50 oil stock) and secondary (cylinder oil stock) recovery systems so that heat from the recovered primary solvent is used to operate the secondary recovery system. This exchanger reduces the heating requirement by 14 percent and the cooling requirement by 11 percent of the values needed if the two systems were operated independently.

Asphalt Recovery (Not Shown)

The flow of asphalt raffinate from the secondary fractionator 216 is the same as described above for the first embodiment, which is shown in the process flow diagram of FIGS. 1*a* and 1*b*. Operating conditions are the same as described above for the first embodiment except that the asphalt flash drum 64 (in FIG. 1*b*) operates at a pressure sufficiently high to allow recovery of condensed propane vapors from the asphalt flash drum 64 in the propane accumulator 262 (at 148 degrees F. and 330 psia).

Solvent System

Propane vapors from the primary mix evaporator 230 and secondary mix evaporator 256 are condensed in the propane condenser 234 and collected in the propane accumulator 262. Propane vapors from the asphalt flash drum 64 (in FIG. 1*b*) and compressed propane vapors from the cylinder stock stripper 240, SAE-50 stock stripper 232, and asphalt stripper 44 (in FIG. 1*b*) are condensed in the asphalt propane condenser 246 and collected in propane accumulator 262. Propane is pumped by propane pump 264 under flow control from propane accumulator 262 to the primary fractionator 212 and secondary fractionator 216 as required.

IV. Fourth Embodiment

The process flow for a representative propane deasphalting unit illustrating the fourth embodiment is described below and is depicted schematically in the process flow diagram of FIGS. 2*a* and 2*b* (the second embodiment) when the following items are omitted: secondary high pressure flash tower 148; secondary pressure vapor heat exchanger 150; secondary high pressure propane accumulator 152; and, secondary high pressure propane pump 170. The temperatures and pressures are illustrative of a continuously operating propane deasphalting unit.

Charge Circuit

The charge circuit is the same as described above for the second embodiment (FIGS. 2*a* and 2*b*) which description is incorporated here by reference.

Primary SAE-50 Oil Stock

The operation of this section is similar to the corresponding section in the second embodiment described above and shown in FIGS. 2*a* and 2*b*.

The primary SAE-50 oil stock/propane mix at 180 degrees F. leaves the top of the primary fractionator 112 and flows to the primary recovery system. The pressure of 635 psia at the top of the primary fractionator 112 is maintained by a back pressure control valve. A portion of the propane in the primary SAE-50 oil stock/propane mix is evaporated by condensing steam in the primary steam heater 120. The mix then flows into the primary high pressure flash tower 122 (at 198 degrees F. and 555 psia) where propane vapor is taken overhead. The remaining primary mix liquid is held under level control in the bottom of this tower 122.

The liquid mix flows through the level control valve, where the reduction in pressure permits some further vaporization. The two-phase mixture is then heated in primary pressure vapor heat exchanger 124 against condensing propane vapor from the primary high pressure flash tower 122. The condensed propane flows to the primary high pressure propane accumulator 128 (at 193 degrees F. and 540 psia).

The primary mix flows from primary pressure vapor heat exchanger 124 to the primary low pressure flash tower 126 (at 173 degrees F. or higher and 381 psia or higher) where again propane vapor is taken overhead. The remaining primary mix liquid flows down the tower 126 and is heated by rising propane vapors from the primary reboiler 130. This heat exchange is effected on two contacting trays in the tower 126. The primary mix leaving the tower 126 flows to the primary reboiler 130 where it is heated by steam. Evaporated propane returns to the primary low pressure flash tower 126 below the bottom tray.

From the primary reboiler 130, the remaining primary mix (at 260 degrees F.) flows under level control to the top tray of SAE-50 stock stripper 132 (at 260 degrees F. and 18 psia). The remaining propane is stripped overhead with steam which enters the SAE-50 stock stripper 132 below the bottom tray. The SAE-50 product is pumped by the SAE-50 stock product pump 134 from the tower bottom under level control and is cooled to 150 degrees F. in the SAE-50 stock cooler 136 before flowing to battery limits.

Propane vapor from the primary low pressure flash tower 126 is partially condensed in the secondary fractionator overhead exchanger 138 to evaporate propane from the cylinder stock/propane mix. The remaining propane vapor (at 165 degrees F.) is condensed in the primary propane condenser 140 and collected in the primary low pressure propane accumulator 142 (at 148 degrees F. and 330 psia). Propane is pumped by primary low pressure propane pump 144 from primary low pressure propane accumulator 142, combined with propane (at 193 degrees F.) pumped by primary high pressure propane pump 146 from primary high pressure propane accumulator 128 and cooled (to 148 degrees F.) in the primary propane feed cooler 114 before returning to the primary fractionator 112.

Secondary Cylinder Oil Stock

The secondary cylinder stock propane mix from secondary fractionator 116 flows through the secondary fractionator overhead exchanger 138 where a portion of the propane in the secondary cylinder stock/propane mix is evaporated by exchange against condensing propane from the primary low pressure flash tower 126. The secondary cylinder stock/propane mix then flows into secondary low pressure flash tower 154 where propane vapor is taken overhead.

The remaining secondary mix liquid flows down the tower 154 and is heated by rising propane vapors from the secondary reboiler 156. This heat exchange is effected on two contacting trays in the tower 154. The secondary mix leaving the tower 154 flows to the secondary reboiler 156 where it is heated by steam to 260 degrees F. Evaporated propane returns to the secondary low pressure flash tower 154 below the bottom tray. From the secondary reboiler 156, the remaining secondary mix (at 260 degrees F.) flows under level control to the top tray of cylinder stock product stripper 158 (at 260 degrees F. and 18 psia). The remaining propane is stripped overhead with steam which enters the cylinder stock product stripper 158 below the bottom tray. The cylinder stock product is pumped by cylinder stock product pump 160 from the tower 158 bottom under level control and is cooled to 200 degrees F. in the cylinder stock product cooler 162 before flowing to battery limits.

Secondary fractionator overhead exchanger 138 is an innovation which integrates the primary (SAE-50 oil stock) and secondary (cylinder oil stock) recovery systems so that heat in the vapor from the primary low pressure flash tower 126 is used to operate the secondary recovery system, thereby reducing the heating and cooling requirements.

Asphalt Recovery

The flow of asphalt raffinate from the secondary fractionator 116 is the same as described above for the first embodiment, which is shown in the process flow diagram of FIGS. 1*a* and 1*b*.

V. Fifth Embodiment

The process flow for a representative propane deasphalting unit illustrating the fifth embodiment is described below and is depicted schematically in the process flow diagram of FIGS. 2*a* and 2*b* (the second embodiment) when the following items are omitted: primary high pressure flash tower 122; primary pressure vapor heat exchanger 124; primary high pressure propane accumulator 128; and, primary high pressure propane pump 146. The temperatures and pressures are illustrative of a continuously operating propane deasphalting unit.

Charge Circuit

The charge circuit is the same as described above for the second embodiment (FIGS. 2*a* and 2*b*) which is incorporated here by reference.

Primary SAE-50 Oil Stock

The operation of this section is similar to the corresponding section in the second embodiment (FIGS. 2*a* and 2*b*) described above.

The primary SAE-50 oil stock/propane mix at 180 degrees F. leaves the top of the primary fractionator 112 and flows to the primary recovery system. The pressure of 635 psia at the top of the primary fractionator 112 is maintained by a back pressure control valve. A portion of the propane in the primary SAE-50 oil stock/propane mix is evaporated by condensing steam in the primary steam heater 120. The mix then flows into the primary low pressure flash tower 126 (at 173 degrees F. or higher and 381 psia or higher) where most of the propane in the mix is vaporized. The remaining primary mix liquid flows down the tower 126 and is heated by rising propane vapors from the primary reboiler 130. This heat exchange is effected on two contacting trays in the tower 126. The primary mix leaving the tower 126 flows to the primary reboiler 130 where it is heated by steam. Evaporated propane returns to the primary low pressure flash tower 126 below the bottom tray.

From the primary reboiler 130, the remaining primary mix (at 260 degrees F.) flows under level control to the top tray of SAE-50 stock stripper 132 (at 260 degrees F. and 18 psia). The remaining propane is stripped overhead with steam which enters the SAE-50 stock stripper 132 below the bottom tray. The SAE-50 product is pumped by the SAE-50 stock product pump 134 from the tower bottom under level control and is cooled to 150 degrees F. in the SAE-50 stock cooler 136 before flowing to battery limits.

Propane vapor from the primary low pressure flash tower 126 is partially condensed in the secondary fractionator overhead exchanger 138 to evaporate propane from the cylinder stock/propane mix. The remaining propane vapor (at 165 degrees F.) is condensed in the primary propane condenser 140 and collected in the primary low pressure propane accumulator 142 (at 148 degrees F. and 330 psia). Propane is pumped by primary low pressure propane pump 144 from primary low pressure propane accumulator 142 and cooled (to 148 degrees F.) in the primary propane feed cooler 114 before returning to the primary fractionator 112.

Secondary Cylinder Oil Stock

The operation of this section is the same as the corresponding section described above in the second embodiment (FIGS. 2*a* and 2*b*) which description is incorporated here by reference.

Secondary fractionator overhead exchanger 138 is an innovation which integrates the primary (SAE-50 oil stock) and secondary (cylinder oil stock) recovery systems so that heat in the vapor from primary low pressure flash tower 126 is used to operate the secondary recovery system, thereby reducing the heating and cooling requirements.

Asphalt Recovery

The flow of asphalt raffinate from the secondary fractionator 116 is the same as described above for the first embodiment, which is shown in the process flow diagram of FIGS. 1*a* and 1*b*.

VI. Sixth Embodiment

The process flow for a representative propane deasphalting unit illustrating the sixth embodiment is described below and is depicted schematically in the process flow diagram of FIGS. 2*a* and 2*b* (the second embodiment) when the following items are omitted: primary high pressure flash tower 122; primary pressure vapor heat exchanger 124; primary high pressure propane accumulator 128; primary high pressure propane pump 146; secondary high pressure flash tower 148; secondary pressure vapor heat exchanger 150; secondary high pressure propane accumulator 152; and, secondary high pressure propane pump 170. The temperatures and pressures are illustrative of a continuously operating propane deasphalting unit.

Charge Circuit

The charge circuit is the same as the corresponding section described above for the second embodiment (FIGS. 2*a*, and 2*b*), which description is incorporated herein by reference.

Primary SAE-50 Oil Stock

The operation of this section is similar to the corresponding section in the second embodiment (FIGS. 2*a* and 2*b*) described above.

The primary SAE-50 oil stock/propane mix at 180 degrees F. leaves the top of the primary fractionator 112 and flows to the primary recovery system. The pressure of 635 psia at the top of the primary fractionator 112 is maintained by a back pressure control valve. A portion of the propane in the primary SAE-50 stock/propane mix is evaporated by condensing steam in the primary steam heater 120.

The primary mix then flows to the primary low pressure flash tower 126 (at 173 degrees F. or higher and 381 psia or higher) where most of the propane is vaporized and taken overhead. The remaining primary mix liquid flows down the tower 126 and is heated by rising propane vapors from the primary reboiler 130. This heat exchange is effected on two contacting trays in the tower 126. The primary mix leaving the tower 126 flows to the primary reboiler 130 where it is heated by steam. Evaporated propane returns to the primary low pressure flash tower 126 below the bottom tray.

From the primary reboiler 130, the remaining primary mix (at 260 degrees F.) flows under level control to the top tray of SAE-50 stock stripper 132 (at 260 degrees F. and 18 psia). The remaining propane is stripped overhead with steam which enters the SAE-50 stock stripper 132 below the bottom tray. The SAE-50 product is pumped by the SAE-50 stock product pump 134 from the tower bottom under level control and is cooled to 150 degrees F. in the SAE-50 stock cooler 136 before flowing to battery limits.

Propane vapor from the primary low pressure flash tower 126 is partially condensed in the secondary fractionator overhead exchanger 138 to evaporate propane from the cylinder stock/propane mix. The remaining propane vapor (at 165 degrees F.) is condensed in the primary propane condenser 140 and collected in the primary low pressure propane accumulator 142 (at 148 degrees F. and 330 psia). Propane is pumped by primary low pressure propane pump 144 from primary low pressure propane accumulator 142 and cooled (to 148 degrees F.) in the primary propane feed cooler 114 before returning to the primary fractionator 112.

Secondary Cylinder Oil Stock

The secondary cylinder stock/propane mix at 152 degrees F. leaves the top of the secondary fractionator 116 and flows to the secondary recovery system. The pressure of 465 psia at the top of the secondary fractionator 116 is maintained by a back pressure control valve. A portion of the propane in the secondary cylinder stock/propane mix is evaporated by heat exchange against condensing propane from the primary low pressure flash tower 126 in the secondary fractionator overhead exchanger 138.

The secondary mix flows from the secondary fractionator overhead exchanger 138 to the secondary low pressure flash tower 154 (at 127 degrees F. and 232 psia) where propane vapor is taken overhead. The remaining secondary mix liquid flows down the tower 154 and is heated by rising propane vapors from the secondary reboiler 156. This heat exchange is effected on two contacting trays in the tower 154. The secondary mix leaving the tower 154 flows to the secondary reboiler 156 where it is heated by steam to 260 degrees F. Evaporated propane returns to the secondary low pressure flash tower 154 below the bottom tray. From the secondary reboiler 156, the remaining secondary mix (at 260 degrees F.) flows under level control to the top tray of cylinder stock product stripper 158 (at 260 degrees F. and 18 psia). The remaining propane is stripped overhead with steam which enters the cylinder stock product stripper 158 below the bottom tray. The cylinder stock product is pumped by cylinder stock product pump 160 from the tower 158 bottom under level control and is cooled to 200 degrees F. in the cylinder stock product cooler 162 before flowing to battery limits.

Propane flashed in the secondary low pressure flash tower 154 is condensed in the secondary propane condenser 164 and flows to the secondary low pressure propane accumulator 166 (at 115 degrees F. and 221 psia). Propane from the asphalt flash drum (not shown), which operates at the same pressure (221 psia) is condensed in a separate asphalt propane condenser 168 and flows to the secondary low pressure propane accumulator 166. Propane is pumped by secondary low pressure propane pump 172 from secondary low pressure propane accumulator 166 and cooled in the secondary propane feed cooler 118 before returning to the secondary fractionator 116.

Makeup propane is pumped from offsite propane storage to the primary low pressure propane accumulator 142 as required.

Secondary fractionator overhead exchanger 138 is an innovation which integrates the primary (SAE-50 oil stock) and secondary (cylinder oil stock) recovery systems so that heat in the vapor from primary flash tower 126 is used to operate the secondary recovery system, thereby reducing the heating and cooling requirements.

Asphalt Recovery

The flow of asphalt raffinate from the secondary fractionator 116 is the same as described above for the first embodiment, which is shown in the process flow diagram of FIGS. 1*a* and 1*b*.

VII. Seventh Embodiment

The process flow for a representative propane deasphalting unit illustrating the seventh embodiment is described below and is depicted schematically in the process flow diagram of FIGS. 1*a* and 1*b* (the first embodiment) when the following items are omitted: secondary high pressure flash tower 54; secondary pressure vapor heat exchanger 36; high pressure propane accumulator 18; and, high pressure propane pump 17. The temperatures and pressures are illustrative of a continuously operating propane deasphalting unit.

Charge Circuit

The charge circuit is the same as the corresponding section described above for the first embodiment (FIGS. 1*a* and 1*b*) which description is incorporated herein by reference.

Primary SAE-50 Oil Stock

Operation of this section is the same as the corresponding section described above for the first embodiment (FIGS. 1*a* and 1*b*) which is incorporated by reference here except that the propane vaporized in the primary SAE-50 mix evaporator 32 is sent to the secondary propane condenser 68.

Secondary Cylinder Oil Stock

The operation of this section is similar to the corresponding section in the first embodiment (FIGS. 1*a* and 1*b*) described above.

The secondary cylinder stock/propane mix from secondary fractionator 20 flows through the secondary fractionator overhead exchanger 28 where a portion of the propane in the secondary cylinder stock/propane mix is evaporated by exchange against the light phase from the primary clarifier 16. The mix then flows into the secondary low pressure flash tower 56 where propane vapor is taken overhead. Operation of secondary low pressure flash tower 56 is as described above in the first embodiment (FIGS. 1*a* and 1*b*) which description is incorporated here by reference.

Secondary fractionator overhead exchanger 28 is an innovation which integrates the primary (SAE-50 oil stock) and secondary (cylinder oil stock) recovery systems so that heat recovered from the primary solvent is used to operate the secondary recovery system, thereby reducing the heating and cooling requirements.

Asphalt Recovery

The flow of asphalt raffinate from the secondary fractionator 20 is the same as desqribed above for the first embodiment, which is shown in the process flow diagram of FIGS. 1*a* and 1*b*.

The above-described embodiments are intended to be illustrative, not restrictive. The full scope of the invention is defined by the claims, and any and all equivalents are intended to be embraced.

What is claimed is:

1. An energy-efficient continuous process for solvent deasphalting a viscous hydrocarbon oil and recovering the solvent, which comprises:

(a) contacting said viscous hydrocarbon oil with a deasphalting solvent under deasphalting conditions of temperature and pressure in a primary fractionator (12);

(b) withdrawing the primary raffinate from the primary fractionator (12) and feeding said primary raffinate to a secondary fractionator (20);

(c) contacting said primary raffinate of step (b) with a deasphalting solvent under deasphalting conditions of temperature and pressure in said secondary fractionator (20);

(d) withdrawing the secondary extract from said secondary fractionator (20) and feeding said secondary extract to a secondary fractionator overhead exchanger (28) and then to a secondary high pressure flash tower (54);

(e) withdrawing asphalt mix from said secondary fractionator (20) and feeding said asphalt mix to an asphalt recovery section;

(f) withdrawing the primary extract from the primary fractionator (12) and feeding said primary extract to a primary fractionator overhead exchanger (24) and then to a primary steam heater (26) and then to a primary clarifier (16) operated at conditions above the critical temperature and pressure of the deasphalting solvent;

(g) withdrawing the light phase from said primary clarifier (16) and using said light phase to heat the primary extract in the primary fractionator overhead exchanger (24) and then to heat and evaporate deasphalting solvent in said secondary extract of step (d) in the secondary fractionator overhead exchanger (28);

(h) withdrawing the heavy phase from said primary clarifier (16) and heating said heavy phase to evaporate deasphalting solvent in a primary mix evaporator (32);

(i) withdrawing the deasphalting solvent vapor from said primary mix evaporator (32) and feeding said deasphalting solvent vapor to a secondary pressure vapor heat exchanger (36) where said deasphalting solvent vapor is condensed;

(j) withdrawing said deasphalting solvent from said secondary pressure vapor heat exchanger (36) and storing said deasphalting solvent in a high pressure solvent accumulator (18) and recycling said deasphalting solvent to the primary fractionator (12) and to the secondary fractionator (20);

(k) withdrawing the deasphalting solvent vapor from the secondary high pressure flash tower (54) and feeding the deasphalting solvent vapor to a secondary pressure vapor heat exchanger (36) where the deasphalting solvent is condensed and storing said deasphalting solvent in the high pressure solvent accumulator (18) and recycling said deasphalting solvent to the primary fractionator (12) and to the secondary fractionator (20);

(l) withdrawing the secondary mix from the secondary high pressure flash tower (54) and feeding said secondary mix to the secondary pressure vapor heat exchanger (36) and then to a secondary low pressure flash tower (56);

withdrawing the secondary mix from the secondary low pressure flash tower (56) and feeding said secondary mix to a secondary reboiler (57); and, (n) withdrawing the deasphalting solvent vapor from said secondary low pressure flash tower (56) and condensing the deasphalting solvent vapor in a secondary solvent condenser (68) and storing said deasphalting solvent in a low pressure solvent accumulator (70) and recycling the deasphalting solvent to the secondary fractionator (20).

2. The process of claim 1 wherein the deasphalting solvent is selected from the group consisting of propane, butane, pentane, hexane, heptane and isomers and mixtures thereof.

3. The process of claim 1 wherein the deasphalting solvent is propane.

4. An energy-efficient continuous process for solvent deasphalting a viscous hydrocarbon oil and recovering the solvent, which comprises:

(a) contacting said viscous hydrocarbon oil with a deasphalting solvent under deasphalting conditions of temperature and pressure in a primary fractionator (112);

(b) withdrawing the primary raffinate from the primary fractionator (112) and feeding said primary raffinate to a secondary fractionator (116);

(c) contacting said primary raffinate of step (b) with a deasphalting solvent under deasphalting conditions of temperature and pressure in said secondary fractionator (116);

(d) withdrawing the secondary extract from said secondary fractionator (116) and feeding said secondary extract to a secondary fractionator overhead exchanger (138) and then to a secondary high pressure flash tower (148);

(e) withdrawing asphalt mix from said secondary fractionator (116) and feeding said asphalt mix to an asphalt recovery section;

(f) withdrawing the primary extract from the primary fractionator (112) and feeding said primary extract to a primary steam heater (120) and then to a primary high pressure flash tower (122) where the deasphalting solvent vapor is taken overhead;

(g) withdrawing the primary mix liquid from said primary high pressure flash tower (122) and heating said primary mix liquid in a primary pressure vapor heat exchanger (124) against condensing deasphalting solvent vapor taken overhead from the primary high pressure flash tower (122);

(h) withdrawing the condensed deasphalting solvent from the primary pressure vapor heat exchanger (124) and storing said deasphalting solvent in a primary high pressure deasphalting solvent accumulator (128) for recycling to the primary fractionator (112);

(i) withdrawing the primary mix from the primary pressure vapor heat exchanger (124) and feeding said primary mix to a primary low pressure flash tower (126) where the deasphalting solvent vapor is taken overhead;

(j) withdrawing the primary mix from the primary low pressure flash tower (126) and feeding said primary mix to a primary reboiler (130);

(k) withdrawing the deasphalting solvent vapor from said primary low pressure flash tower (126) and using the heat in said deasphalting solvent vapor to evaporate deasphalting solvent from the secondary extract of step (d) in the secondary fractionator overhead exchanger (138);

(l) withdrawing the deasphalting solvent vapor that came from said primary low pressure flash tower (126) from said secondary fractionator overhead exchanger (138) and feeding said deasphalting solvent vapor to a primary solvent condenser (140) where said deasphalting solvent vapor is condensed;

(m) withdrawing said deasphalting solvent from said primary solvent condenser (140) and storing said deasphalting solvent in a primary low pressure solvent accumulator (142) and recycling said deasphalting solvent to the primary fractionator (112);

(n) withdrawing the deasphalting solvent vapor from the secondary high pressure flash tower (148) and feeding said deasphalting solvent vapor to a secondary pressure vapor heat exchanger (150) where the solvent is condensed and storing said deasphalting solvent in a secondary high pressure solvent accumulator (152) and recycling said deasphalting solvent to the secondary fractionator (116);

(o) withdrawing the secondary mix from the secondary high pressure flash tower (148) and feeding said secondary mix to a secondary pressure vapor heat exchanger (150) where solvent is evaporated by heat exchange against condensing solvent vapors from the secondary high pressure flash tower (148) and then feeding the secondary mix to a secondary low pressure flash tower (154); and, (p) withdrawing the deasphalting solvent vapor from said secondary low pressure flash tower (154) and condensing said deasphalting solvent vapor in a secondary solvent condenser (164) and storing said deasphalting solvent in a secondary low pressure solvent accumulator (166) and recycling said deasphalting solvent to the secondary fractionator (116).

5. The process of claim 4 wherein the deasphalting solvent is selected from the group consisting of propane, butane, pentane, hexane, heptane, and isomers and mixtures thereof.

6. The process of claim 4 wherein the deasphalting solvent is propane.

7. An energy-efficient continuous process for solvent deasphalting a viscous hydrocarbon oil and recovering the solvent, which comprises:

(a) contacting said viscous hydrocarbon oil with a deasphalting solvent under deasphalting conditions of temperature and pressure in a primary fractionator (212);

(b) withdrawing the primary raffinate from the primary fractionator (212) and feeding said primary raffinate to a secondary fractionator (216);

(c) contacting said primary raffinate of step (b) with a deasphalting solvent under deasphalting conditions of temperature and pressure in said secondary fractionator (216);

(d) withdrawing the secondary extract from said secondary fractionator (216) and feeding said secondary extract to a secondary fractionator overhead exchanger (252) and then to a primary/secondary exchanger (228) and then to a secondary steam heater (254) and then to a secondary clarifier (220);

(e) withdrawing asphalt mix from said secondary fractionator (216) and feeding said asphalt mix to an asphalt recovery section;

(f) withdrawing the primary extract from the primary fractionator (212) and feeding said primary extract to a primary fractionator overhead exchanger (226) and then to a primary steam heater (224) and then to a primary clarifier (214) operated at conditions above the critical temperature and pressure of the deasphalting solvent;

(g) withdrawing the light phase from said primary clarifier (214) and using said light phase to heat the primary extract of step (c) and then to heat said secondary extract of step (d) in the primary/secondary exchanger (228);

(h) withdrawing the heavy phase from said primary clarifier (214) and heating said heavy phase to evaporate deasphalting solvent in a primary mix evaporator (230);

(i) withdrawing the deasphalting solvent from said primary mix evaporator (230) and condensing the deasphalting solvent vapor in a solvent condenser (234) and storing said condensed deasphalting solvent in a solvent accumulator (262) and recycling said deasphalting solvent to the primary fractionator (212);

(j) withdrawing the deasphalting solvent from the secondary clarifier (220) and using said deasphalting solvent to heat said secondary extract of step (d) in the secondary fractionator overhead exchanger (252) and then recycling said deasphalting solvent to the secondary fractionator (216);

(k) withdrawing the secondary mix from the secondary clarifier (220) and feeding said secondary mix to a secondary mix evaporator (256); and, (l) withdrawing the deasphalting solvent from said secondary mix evaporator (256) and condensing the deasphalting solvent in a solvent condenser (234) and storing said condensed deasphalting solvent in said propane accumulator (262) and recycling said deasphalting solvent to the primary fractionator (212).

8. The process of claim 7 wherein the deasphalting solvent is selected from the group consisting of propane, butane, pentane, hexane, heptane, and isomers and mixtures thereof.

9. The process of claim 7 wherein the deasphalting solvent is propane.

10. An energy-efficient continuous process for solvent deasphalting a viscous hydrocarbon oil and recovering the solvent, which comprises:

(a) contacting said viscous hydrocarbon oil with a deasphalting solvent under deasphalting conditions of temperature and pressure in a primary fractionator (112);

(b) withdrawing the primary raffinate from the primary fractionator (112) and feeding said primary raffinate to a secondary fractionator (116);

(c) contacting said primary raffinate of step (b) with a deasphalting solvent under deasphalting conditions of temperature and pressure in said secondary fractionator (116);

(d) withdrawing the secondary extract from said secondary fractionator (116) and feeding said secondary extract to a secondary fractionator overhead exchanger (138) and then to a secondary low pressure flash tower (154);

(e) withdrawing asphalt mix from said secondary fractionator (116) and feeding said asphalt mix to a asphalt recovery section;

(f) withdrawing the primary extract from the primary fractionator (112) and feeding said primary extract to a primary steam heater (122) and then to a primary high pressure flash tower (122) where the deasphalting solvent vapor is taken overhead;

(g) withdrawing the primary mix liquid from said primary high pressure flash tower (122) and heating said primary mix liquid in a primary pressure vapor heat exchanger (124) against condensing deasphalting solvent vapor taken overhead from the primary high pressure flash tower (122);

(h) withdrawing the condensed deasphalting solvent from the primary pressure vapor heat exchanger (124) and storing said deasphalting solvent in a primary high pressure deasphalting solvent accumulator (128) for recycling to the primary fractionator (112);

(i) withdrawing the primary mix from the primary pressure vapor heat exchanger (124) and feeding said primary mix to a primary low pressure flash tower (126) where the deasphalting solvent vapor is taken overhead;

(j) withdrawing the primary mix from the primary low pressure flash tower (126) and feeding said primary mix to a primary reboiler (130);

(k) withdrawing the deasphalting solvent vapor from said primary low pressure flash tower (126) and using the heat in said deasphalting solvent vapor to evaporate deasphalting solvent from the secondary extract of step (d) in the secondary fractionator overhead exchanger (138);

(l) withdrawing the deasphalting solvent vapor that came from said primary low pressure flash tower (126) from said secondary fractionator overhead exchanger (138) and feeding said deasphalting solvent vapor to a primary solvent condenser (140) where said deasphalting solvent vapor is condensed;

(m) withdrawing said deasphalting solvent from said primary solvent condenser (140) and storing deasphalting solvent in a primary low pressure solvent accumulator (142) and recycling said deasphalting solvent to the primary fractionator (112); and, (n) withdrawing the deasphalting solvent vapor from said secondary low pressure flash tower (154) and condensing the deasphalting solvent vapor in a secondary solvent condenser (164) and storing said deasphalting solvent in a secondary low pressure solvent accumulator (166) and recycling said deasphalting solvent to the secondary fractionator (116).

11. The process of claim 10 wherein the deasphalting solvent is selected from the group consisting of propane, butane, pentane, hexane, heptane, and isomers and mixtures thereof.

12. The process of claim 10 wherein the deasphalting solvent is propane.

13. An energy-efficient continuous process for solvent deasphalting a viscous hydrocarbon oil and recovering the solvent, which comprises:

(a) contacting said viscous hydrocarbon oil with a deasphalting solvent under deasphalting conditions of temperature and pressure in a primary fractionator (112);

(b) withdrawing the primary raffinate from the primary fractionator (112) and feeding said primary raffinate to a secondary fractionator (116);

(c) contacting said primary raffinate of step (b) with a deasphalting solvent under deasphalting conditions of temperature and pressure in said secondary fractionator (116);

(d) withdrawing the secondary extract from said fractionator (116) and feeding said secondary extract to a secondary fractionator overhead exchanger (138) and then to a secondary high pressure flash tower (148);

(e) withdrawing asphalt mix from said secondary fractionator (116) and feeding said asphalt mix to an asphalt recovery section;

(f) withdrawing the primary extract from the primary fractionator (112) and feeding said primary extract to a primary steam heater (122) and then to a primary low pressure flash tower (126) where the deasphalting solvent vapor is taken overhead;

(g) withdrawing the primary mix from the primary low pressure flash tower (126) and feeding said primary mix to a primary reboiler (130);

(h) withdrawing the deasphalting solvent vapor from said primary low pressure flash tower (126) and using the heat in said deasphalting solvent to evaporate deasphalting solvent from the secondary extract of step (d) in the secondary fractionator overhead exchanger (138);

(i) withdrawing the deasphalting solvent vapor that came from said primary low pressure flash tower (126) from said secondary fractionator overhead exchanger (138) and feeding said deasphalting solvent vapor to a primary solvent condenser (140) where said deasphalting solvent vapor is condensed;

(j) withdrawing said deasphalting solvent vapor from said primary solvent condenser (140) and storing said deasphalting solvent in a primary low pressure solvent accumulator (142) and recycling said deasphalting solvent to the primary fractionator (112);

(k) withdrawing the deasphalting solvent from the secondary high pressure flash tower (148) and condensing the deasphalting solvent vapor in a secondary pressure vapor heat exchanger (150) and storing said deasphalting solvent in a secondary high pressure solvent accumulator (152) and recycling said deasphalting solvent to the secondary fractionator (116);

(l) withdrawing the secondary mix from the secondary high pressure flash tower (148) and evaporating solvent in the secondary mix by heat exchange with the solvent vapor from the secondary high pressure flash tower (148) in the secondary pressure vapor heat exchanger (150) and feeding said secondary mix to a secondary low pressure flash tower (154); and, (m) withdrawing the deasphalting solvent vapor from said secondary low pressure flash tower (154) and condensing the deasphalting solvent vapor in a secondary solvent condenser (164) and storing said deasphalting solvent in a secondary low pressure solvent accumulator (166) and recycling deasphalting solvent to the secondary fractionator (116).

14. The process of claim 13 wherein the deasphalting solvent is selected from the group consisting of propane, butane, pentane, hexane, heptane, and isomers and mxtures thereof.

15. The process of claim 13 wherein the deasphalting solvent is propane.

16. An energy-efficient continuous process for solvent deasphalting a viscous hydrocarbon oil and recovering the solvent, which comprises:

(a) contacting said viscous hydrocarbon oil with a deasphalting solvent under deasphalting conditions of temperature and pressure in a primary fractionator (112);

(b) withdrawing the primary raffinate from the primary fractionator (112) and feeding said primary raffinate to a secondary fractionator (116);

(c) contacting said primary raffinate of step (b) with a deasphalting solvent under deasphalting conditions of temperature and pressure in said secondary fractionator (116);

(d) withdrawing the secondary extract from said secondary fractionator (116) and feeding said secondary extract to a secondary fractionator overhead exchanger (138) and then to a secondary low pressure flash tower (154);

(e) withdrawing asphalt mix from said secondary fractionator (116) and feeding said asphalt mix to an asphalt recovery section;

(f) withdrawing the primary extract from the primary fractionator (112) and feeding said primary extract to a primary steam heater (120) and then feeding the primary extract to a primary low pressure flash tower (126) where the deasphalting solvent vapor is taken overhead;

(g) withdrawing the primary mix from the primary low pressure flash tower (126) and feeding said primary mix to a primary reboiler (130);

(h) withdrawing the deasphalting solvent vapor from said primary low pressure flash tower (126) and using the heat in said deasphalting solvent vapor to evaporate deasphalting solvent from the secondary extract of step (d) in the secondary overhead exchanger (138);

(i) withdrawing the deasphalting solvent vapor that came from said primary low pressure flash tower (126) from said secondary fractionator overhead exchanger (138) and feeding said deasphalting solvent vapor to a primary solvent condenser (140) where said deasphalting solvent vapor is condensed;

(j) withdrawing said deasphalting solvent from said primary solvent condenser (140) and storing said deasphalting solvent in a primary low pressure solvent accumulator (142) and recycling said deasphalting solvent to the primary fractionator (112); and, (k) withdrawing said deasphalting solvent vapor from said secondary low pressure flash tower (154) and condensing the deasphalting solvent vapor in a secondary solvent condenser (164) and storing said deasphalting solvent in a secondary low pressure solvent accumulator (166) and recycling said deasphalting solvent to the secondary fractionator (116).

17. The process of claim 16 wherein the deasphalting solvent is selected from the group consisting of propane, butane, pentane, hexane, heptane, and isomers and mixtures thereof.

18. The process of claim 16 wherein the deasphalting solvent is propane.

19. An energy-efficient continuous process for solvent deasphalting a viscous hydrocarbon oil and recovering the solvent, which comprises:

(a) contacting said viscous hydrocarbon oil with a deasphalting solvent under deasphalting conditions of temperature and pressure in a primary fractionator (12);

(b) withdrawing the primary raffinate from the primary fractionator (12) and feeding said primary raffinate to a secondary fractionator (20);

(c) contacting said primary raffinate of step (b) with a deasphalting solvent under deasphalting conditions of temperature and pressure in said secondary fractionator (20);

(d) withdrawing the secondary extract from said secondary fractionator (20) and feeding said secondary extract to a secondary fractionator overhead exchanger (28) and then to a secondary low pressure flash tower (56);

(e) withdrawing asphalt mix from said secondary fractionator (20) and feeding said asphalt mix to an asphalt recovery section;

(f) withdrawing the primary extract from the primary fractionator (12) and feeding said primary extract to a primary fractionator overhead exchanger (24) and then to a primary steam heater (26) and then to a primary clarifier (16) operated at conditions above the critical temperature and pressure of the deasphalting solvent;

(g) withdrawing the light phase from said primary clarifier (16) and using said light phase to heat and evaporate deasphalting solvent in said secondary extract of step (d) in the secondary fractionator overhead exchanger (28);

(h) withdrawing the heavy phase from said primary clarifier (16) and heating said heavy phase to evaporate deasphalting solvent in a primary mix evaporator (32);

(i) withdrawing the deasphalting solvent vapor from said primary mix evaporator (32) and feeding said deasphalting solvent vapor to a secondary solvent condenser (68) where said deasphalting solvent vapor is condensed;

(j) withdrawing said deasphalting solvent from said secondary solvent condenser (68) and storing said deasphalting solvent in a secondary low pressure solvent accumulator (70) and recycling the deasphalting solvent to the secondary fractionator (20);

(k) withdrawing the deasphalting solvent vapor from said secondary low pressure flash tower (56) and feeding said deasphalting vapor to the secondary solvent condenser (68) where said deasphalting solvent vapor is condensed; and, (l) withdrawing said deasphalting solvent from said secondary solvent condenser (68) and storing said deasphalting solvent in said secondary low pressure solvent accumulator (70) and recycling the deasphalting solvent to the secondary fractionator (20).

20. The process of claim 19 wherein the deasphalting solvent is selected from the group consisting of propane, butane, pentane, hexane, heptane, and isomers and mixtures thereof.

21. The process of claim 19 wherein the deasphalting solvent is propane.

* * * * *